US012257483B2

(12) United States Patent
Mizutani et al.

(10) Patent No.: US 12,257,483 B2
(45) Date of Patent: Mar. 25, 2025

(54) GOLF CLUB HEAD AND GOLF CLUB

(71) Applicant: Sumitomo Rubber Industries, Ltd., Kobe (JP)

(72) Inventors: Naruhiro Mizutani, Kobe (JP); Kiyofumi Matsunaga, Kobe (JP); Jun Kodaka, Kobe (JP); Hirotaka Nakamura, Kobe (JP); Daisuke Kohno, Kobe (JP); Shinya Furuta, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 379 days.

(21) Appl. No.: 17/565,977

(22) Filed: Dec. 30, 2021

(65) Prior Publication Data

US 2022/0226699 A1 Jul. 21, 2022

(30) Foreign Application Priority Data

Jan. 18, 2021 (JP) ..... 2021-006050

(51) Int. Cl.
*A63B 53/04* (2015.01)

(52) U.S. Cl.
CPC ..... *A63B 53/0466* (2013.01); *A63B 53/0412* (2020.08); *A63B 53/0433* (2020.08); *A63B 53/0437* (2020.08); *A63B 2053/0491* (2013.01)

(58) Field of Classification Search
CPC ..... A63B 53/0466; A63B 53/0412; A63B 53/0437; A63B 53/0433; A63B 2053/0491; A63B 53/04; A63B 53/08
USPC ..... 473/324–350, 287–292; D21/733, 759
See application file for complete search history.

(56) References Cited

U.S. PATENT DOCUMENTS

| | | | | |
|---|---|---|---|---|
| 1,946,208 A * | 2/1934 | Hampton | A63B 53/0466 | 428/68 |
| 4,077,633 A * | 3/1978 | Studen | A63B 53/0487 | 473/340 |
| 5,193,810 A * | 3/1993 | Antonious | A63B 60/52 | 473/327 |
| 5,645,495 A * | 7/1997 | Saso | A63B 60/02 | 473/345 |
| 7,252,600 B2 * | 8/2007 | Murphy | A63B 60/00 | 473/345 |

(Continued)

FOREIGN PATENT DOCUMENTS

| | | |
|---|---|---|
| JP | 10-43332 A | 2/1998 |
| JP | 11-267251 A | 10/1999 |

*Primary Examiner* — Sebastiano Passaniti

(74) *Attorney, Agent, or Firm* — Birch, Stewart, Kolasch & Birch, LLP

(57) ABSTRACT

A head includes a face portion, a crown portion, a sole portion, and a hosel portion. The crown portion includes a protruding portion on a crown outer surface. The protruding portion does not form any part of an outer contour line of the head in a front view of the head as viewed from a face side. The protruding portion forms an outer contour line of the head in a heel projection figure in which the head that is placed on a ground plane such that a shaft axis line is (Continued)

perpendicular to the ground plane and a face angle is 0° is viewed from a heel side along the ground plane. In this head, aerodynamic drag and lifting force at a position at which the shaft axis line becomes parallel to the ground plane during downswing can be increased. In this head, air resistance at impact can be suppressed.

16 Claims, 31 Drawing Sheets

(56) References Cited

U.S. PATENT DOCUMENTS 7,713,138 B2 * 5/2010 Sato ..... A63B 53/0466 473/328
8,414,422 B2 * 4/2013 Peralta ..... A63B 53/04 473/335
8,568,247 B1 * 10/2013 Ehlers ..... A63B 53/0466 473/305
8,753,224 B1 * 6/2014 Kim ..... A63B 60/00 473/345
10,130,855 B2 * 11/2018 Stokke ..... A63B 53/06
D988,445 S * 6/2023 Tsuchihashi ..... D21/759
2009/0275419 A1 * 11/2009 Cackett ..... A63B 53/0466 473/282
2011/0244979 A1 * 10/2011 Snyder ..... A63B 60/00 473/327
2011/0247190 A1 10/2011 Evans et al.
2011/0250986 A1 * 10/2011 Schweigert ..... A63B 60/02 473/409
2012/0122607 A1 * 5/2012 Reinberg ..... A63B 60/02 473/334
2014/0031141 A1 * 1/2014 Myrhum ..... A63B 60/02 473/334
2014/0274448 A1 * 9/2014 Willett ..... A63B 53/04 473/327
2015/0094162 A1 * 4/2015 Oldknow ..... A63B 60/52 473/327
2016/0339306 A1 * 11/2016 Simone ..... A63B 60/00
2017/0072274 A1 * 3/2017 Jertson ..... A63B 53/0466
2018/0353818 A1 * 12/2018 Henrikson ..... A63B 60/52
2020/0215397 A1 * 7/2020 Parsons ..... A63B 53/0466
2022/0233921 A1 * 7/2022 Mizutani ..... A63B 53/0462
2022/0322667 A1 * 10/2022 Mendrok-Edinger ... A61K 8/35
2023/0080945 A1 * 3/2023 Mizutani ..... A63B 53/0466 473/349
2024/0058663 A1 * 2/2024 Mizutani ..... A63B 53/06

* cited by examiner

A-A

C–C

FIG. 20A
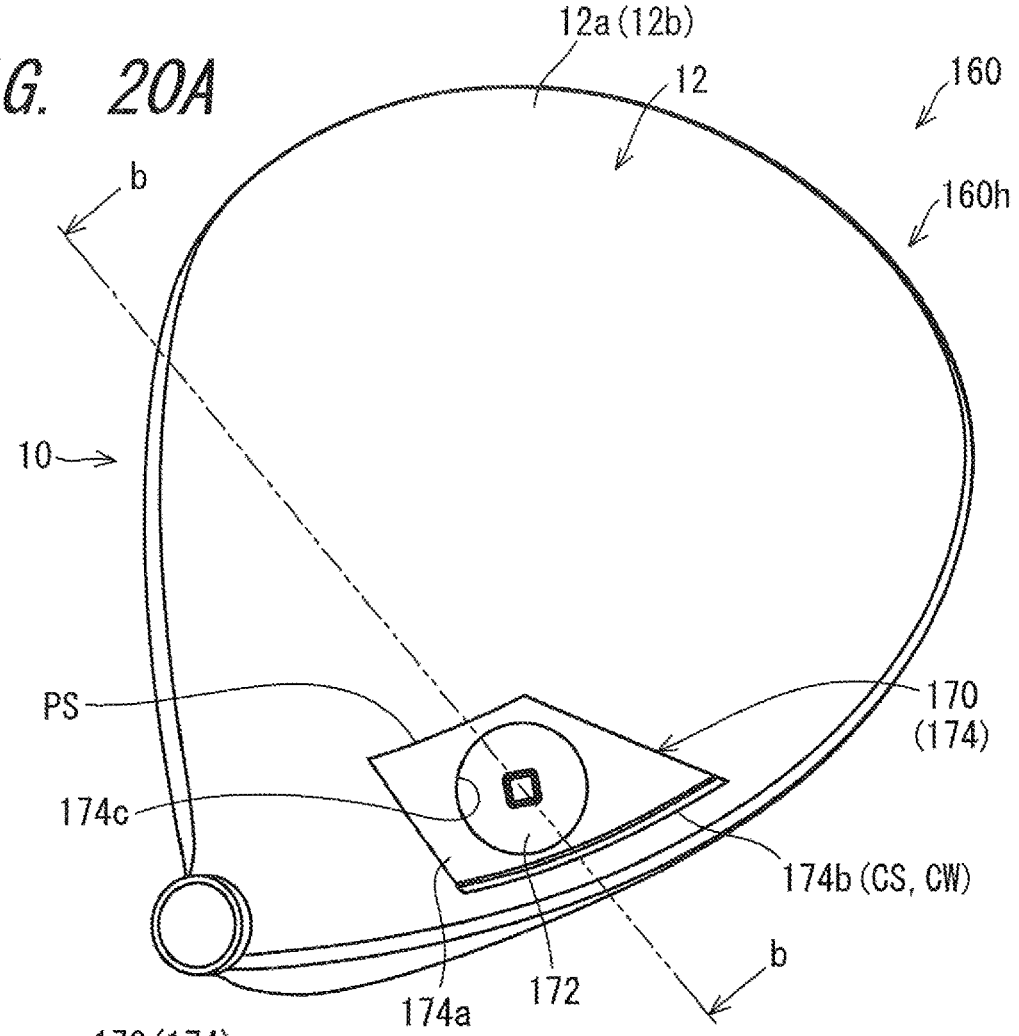
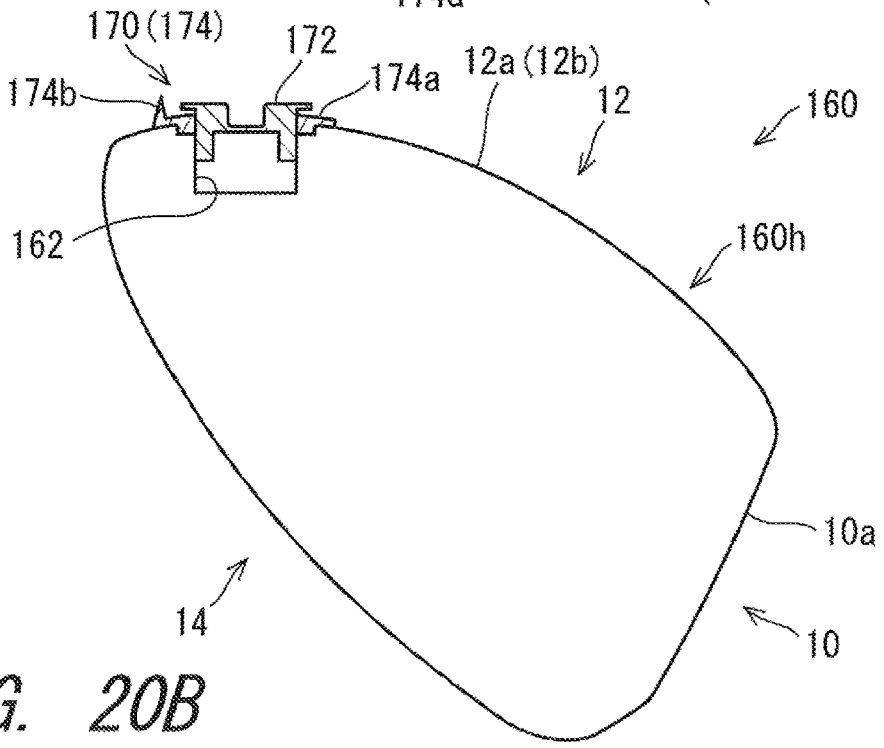
FIG. 20B

GOLF CLUB HEAD AND GOLF CLUB

CROSS REFERENCE TO RELATED APPLICATION

The present application claims priority to Japanese Patent Application No. 2021-006050 filed on Jan. 18, 2021. The entire contents of this Japanese Patent Application are hereby incorporated by reference.

BACKGROUND

Technical Field

The present disclosure relates to a golf club head and a golf club.

Description of the Related Art

As designs advantageous for flight distance, there has been known an upsized head, a lengthened club, and a more flexible shaft for attaining an increased degree of bending, for example. A club that is easy to swing and has a high rebound performance can be obtained by reducing the weight of its shaft while not reducing the weight of its head.

On the other hand, a so-called toe-down phenomenon (hereinafter also simply referred to as "toe down") is one of factors in reduction of flight distance. JPH11-267251 A and JPH10-43332 A have descriptions about the toe-down phenomenon.

SUMMARY

The inventors of the present disclosure have found that the designs advantageous for flight distance can increase the degree of the toe down. It is difficult for conventional golf clubs to attain both suppression of the toe down and increase of flight distance because of a tradeoff relationship between the two.

One of the objects of the present disclosure is to provide a golf club head that can suppress the toe down and is excellent in flight distance performance.

In one aspect, the present disclosure provides a golf club head including a face portion that forms a striking face, a crown portion that forms a crown outer surface, a sole portion that forms a sole outer surface, and a hosel portion that is configured to receive a shaft and that defines a shaft axis line. The crown portion includes a protruding portion on the crown outer surface. In a front view of the head as viewed from a face side, the protruding portion does not form any part of an outer contour line of the head. In a heel projection figure in which the head that is placed on a ground plane such that the shaft axis line is perpendicular to the ground plane and a face angle is set at 0° is viewed from a heel side along the ground plane, the protruding portion forms a part of the outer contour line of the head.

BRIEF DESCRIPTION OF THE DRAWINGS

FIG. 5 is a heel projection figure;

FIG. 20A is a perspective view of a head according to a ninth embodiment, and FIG. 20B is a cross-sectional view taken along line b-b in FIG. 20A, however, the depiction of a cross section of a head body is omitted in FIG. 20B;

DESCRIPTION OF THE PREFERRED EMBODIMENTS (Findings as Basis for the Present Disclosure)

Figure 1:
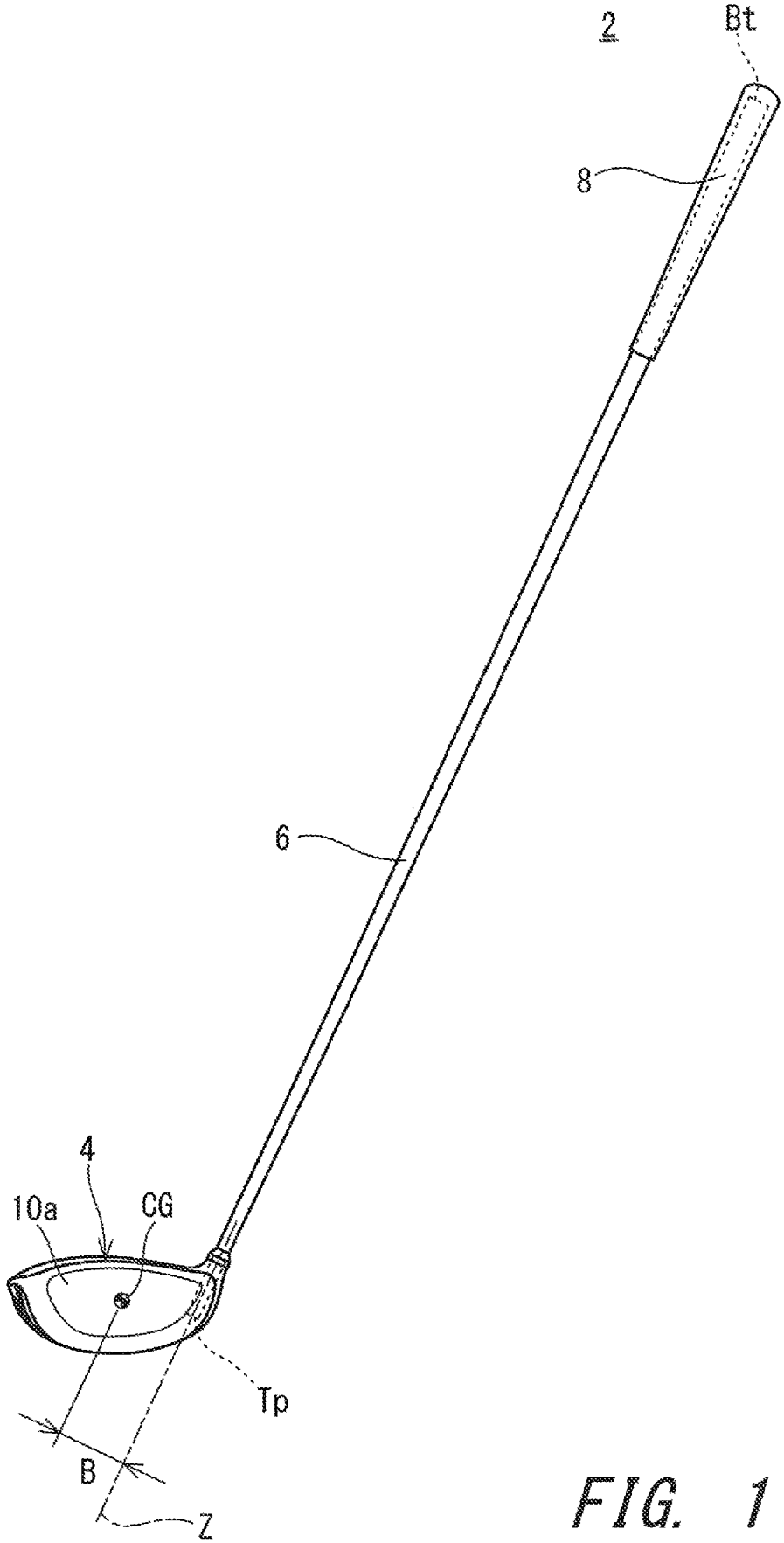
FIG. 1 shows a golf club according to a first embodiment.
Figure 4:
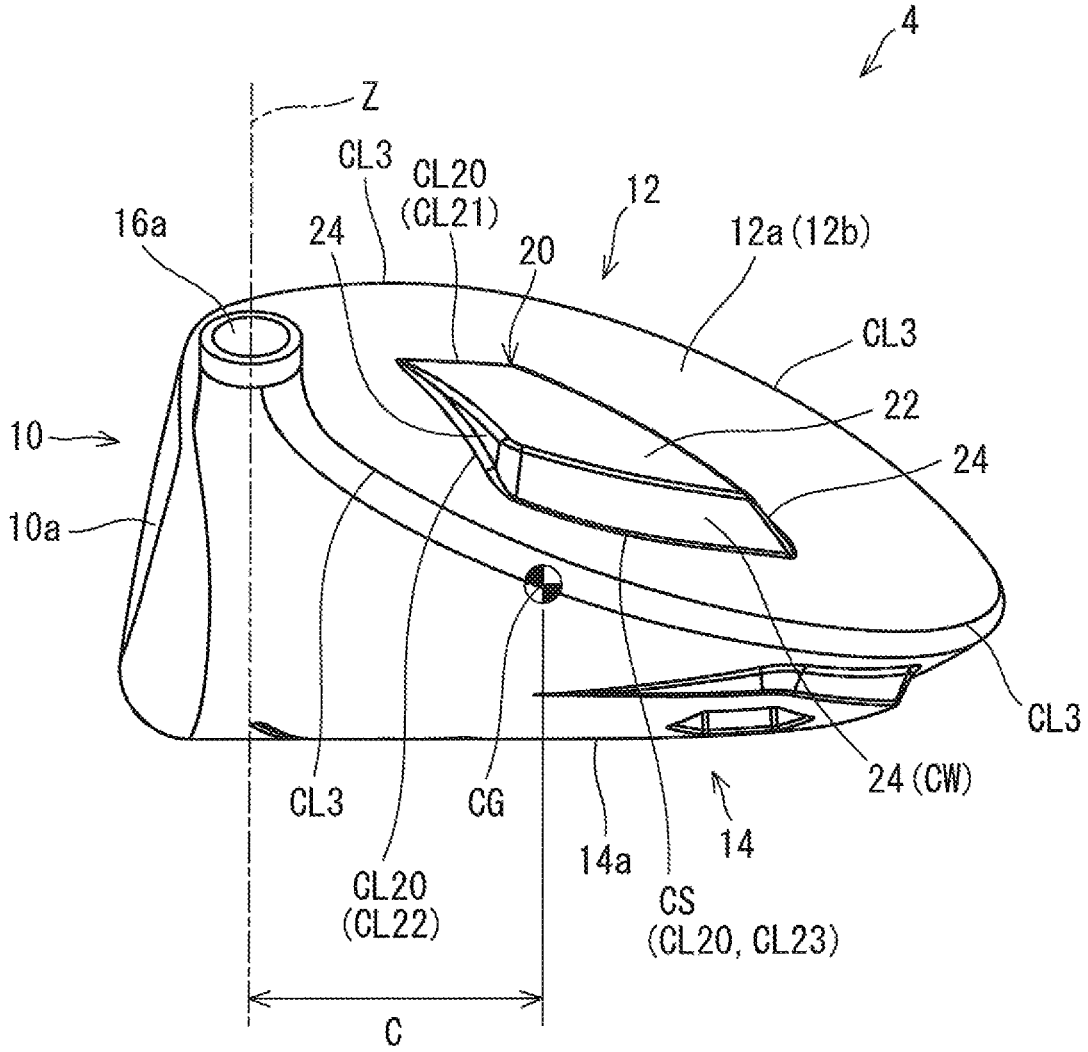
FIG. 4 is a side view of the head of the first embodiment as viewed from a heel side.

The toe-down phenomenon occurs because the center of gravity of a head is positioned apart from a shaft axis line. A centrifugal force acts on the center of gravity of a head during a swing. As shown in FIG. 1, the center of gravity CG of a head is positioned on a toe side with respect to its shaft axis line Z. For this reason, the centrifugal force bends the shaft such that a toe-side portion of the head moves downward. In addition, as shown in FIG. 4, the center of gravity CG of a head is positioned on a back side with respect to its shaft axis line Z. For this reason, the centrifugal force bends the shaft such that the a back-side portion of the head moves downward. Accordingly, the centrifugal force bends and twists the shaft such that the toe-side portion and the back-side portion of the head move downward. The shaft is bent such that the toe-side portion of the head moves downward and is twisted in a direction in which the face of the head is opened. This is known as the toe-down phenomenon. The greater the centrifugal force is, the greater the degree of the toe down is. The greater the distance between the center of gravity of a head and its shaft axis line is, the greater the degree of the toe down is.

As explained above, the centrifugal force moves the toe-side portion of the head downward and also the back-side portion of the head downward. These phenomena can be separately explained as toe down and back down. In the present disclosure, however, these are collectively referred to as toe down (phenomenon).

For suppressing the toe down, a club length may be reduced. This, however, reduces the kinetic energy of the head, thereby reducing flight distance. For suppressing the toe down, a head weight may be reduced. This, however, also reduces the kinetic energy of the head, thereby reducing flight distance.

For suppressing the toe down, the distance of the center of gravity of a head may be reduced and/or the depth of the center of gravity of the head may be shallowed. This, however, narrows an area having a high rebound performance, thereby reducing an average flight distance. In addition, the orientation of the face cannot be stabilized in such a head, whereby an average flight distance is reduced.

For suppressing the toe down, the flexural rigidity of the tip end portion of the shaft may be increased. This, however, lowers the trajectory of a hit ball, thereby reducing flight distance.

For reducing the effect of the toe down, a lie angle may be set to an upright lie angle and/or a face angle may set to a hook face angle. However, a golf club having an upright lie angle and a hook face angle is difficult to address.

A golf club that is easy to swing increases head speed. The increased head speed, however, increases the centrifugal force acting on the center of gravity of the head, which increases the degree of the toe down.

As described above, the factors that increase flight distance can also increase the degree of the toe down. An excessively great degree of the toe down results in inappropriate hit point or inappropriate impact angle of the head. In addition, such an excessively great degree of the toe down causes variation in degree of the toe down, whereby consistent hit points or consistent impact angles of the head cannot be obtained. Accordingly, the toe down tends to cause energy loss at impact.

The inventors of the present disclosure have found that, as explained above, even when a golf club has a feature(s) that can increase flight distance, a great toe down can reduce the flight distance. The inventors of the present disclosure have also found that both flight distance performance and suppression of the toe down can be achieved by suppressing the toe down with novel means.

Hereinafter, the present disclosure will be described in detail according to the preferred embodiments with appropriate references to the accompanying drawings.

In the present disclosure, a reference state, a reference perpendicular plane, a toe-heel direction, a face-back direction, an up-down direction, a face center, a heel projection posture, an inclined toe-heel direction and a heel projection figure are defined as follows.

Figure 31:
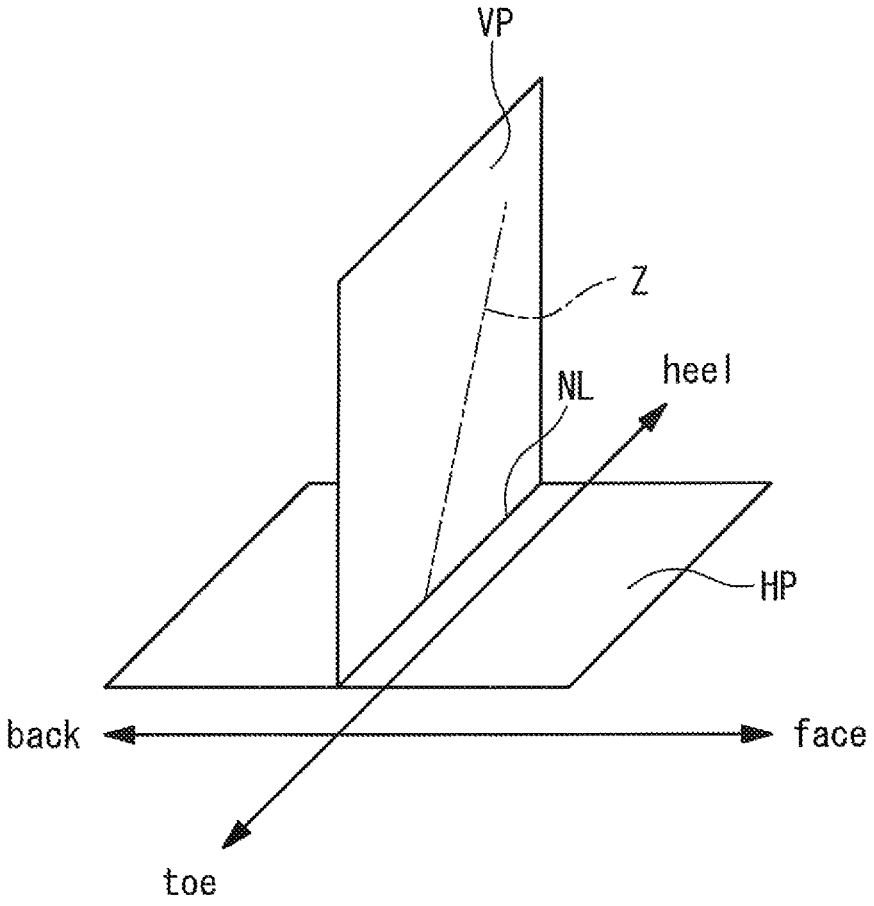
FIG. 31 is a conceptual diagram for illustrating a reference state.

The reference state is a state where a head is placed at a predetermined lie angle on a ground plane HP. As shown in FIG. 31, in the reference state, a shaft axis line Z is contained in a plane VP that is perpendicular to the ground plane HP. The shaft axis line Z is the center line of a shaft. The plane VP is defined as the reference perpendicular plane. The predetermined lie angle is shown in a product catalog, for example.

In the reference state, a face angle is 0°. That is, in a plan view of the head as viewed from above, a tangent line to the head at its face center on a striking face is set to be parallel to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 31).

In the present disclosure, the face-back direction is a direction that is perpendicular to the toe-heel direction and is parallel to the ground plane HP. A face side in the face-back direction is also simply referred to as "face side". A back side in the face-back direction is also simply referred to as "back side".

In the present disclosure, the up-down direction is a direction that is perpendicular to the toe-heel direction and is perpendicular to the face-back direction. In other words, the up-down direction in the present disclosure is a direction perpendicular to the ground plane HP.

In the present disclosure, the face center is determined in the following manner. First, a point Pr is selected roughly at the center of a striking face in the up-down direction and the toe-heel direction. Next, a plane that passes through the point Pr, extends in the direction of a line normal to the striking face at the point Pr, and is parallel to the toe-heel direction is determined. An intersection line between this plane and the striking face is drawn, and a midpoint Px of this intersection line is determined. Next, a plane that passes through the midpoint Px, extends in the direction of a line normal to the striking face at the midpoint Px, and is parallel to the up-down direction is determined. An intersection line between this plane and the striking face is drawn, and a midpoint Py of this intersection line is determined. Next, a plane that passes through the midpoint Py, extends in the direction of a line normal to the striking face at the midpoint Py, and is parallel to the toe-heel direction is determined. An intersection line between this plane and the striking face is drawn, and a midpoint Px of this intersection line is newly determined. Next, a plane that passes through this newly-determined midpoint Px, extends in the direction of a line normal to the striking face at this midpoint Px, and is parallel to the up-down direction is determined. An intersection line between this plane and the striking face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center.

Figure 2A:
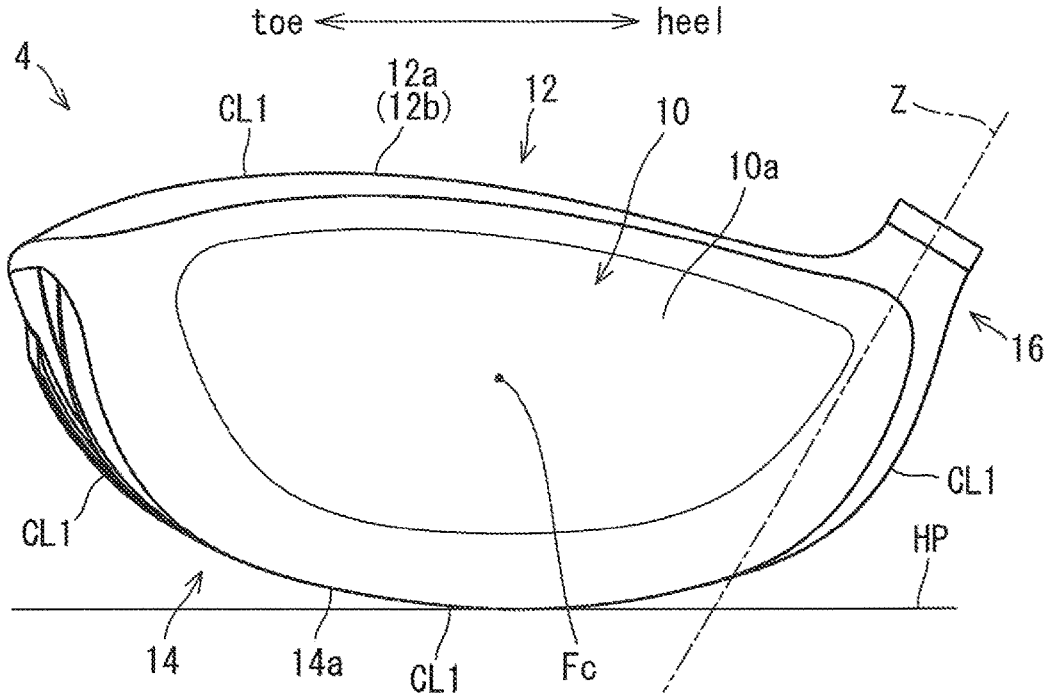
FIG. 2A is a front view of a head of the first embodiment as viewed from a face side, this head being in a reference state.
Figure 2B:
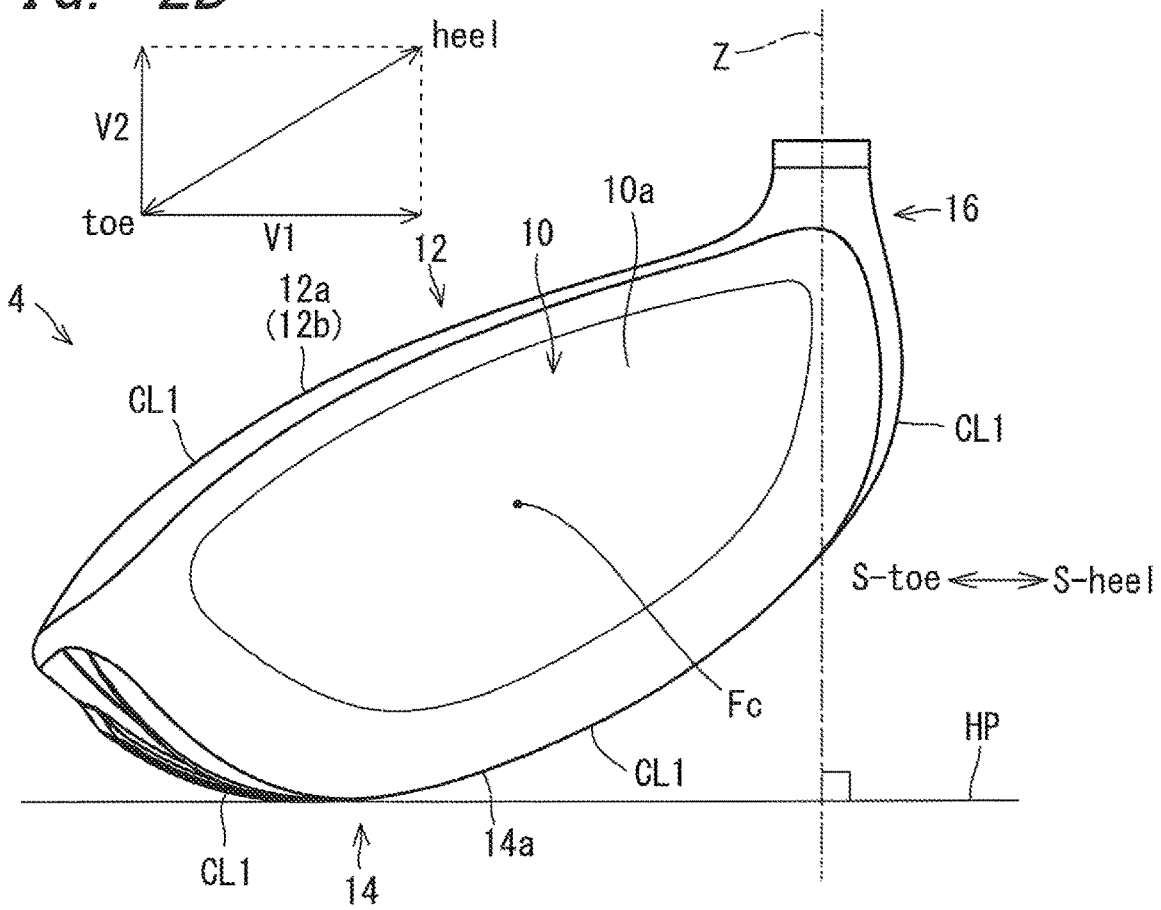
FIG. 2B shows the head of the first embodiment as viewed from the face side, this head being in a heel projection posture.
Figure 5:
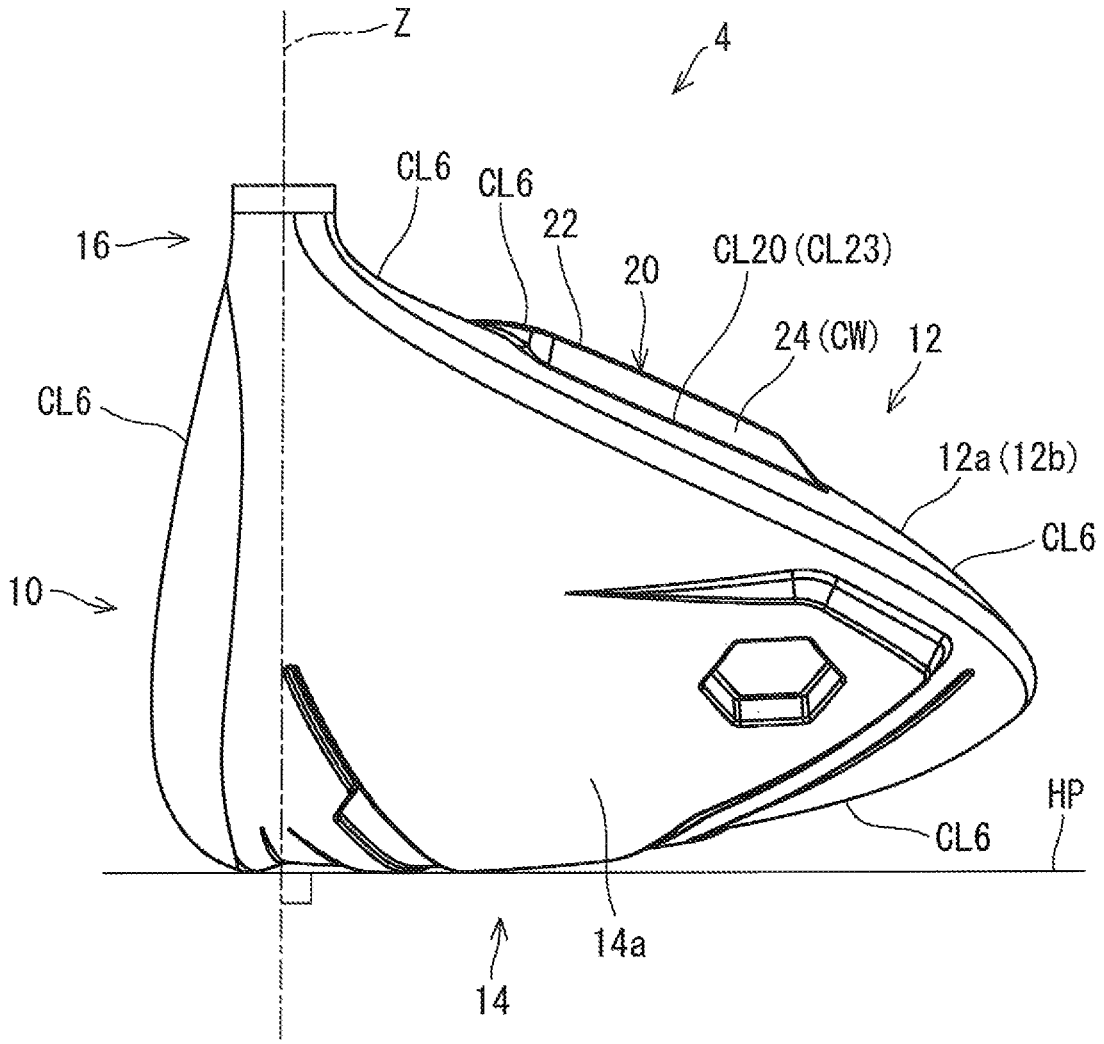
FIG. 5 shows the head of the first embodiment as viewed from an inclined heel side.

The heel projection posture means a posture of a head placed such that the shaft axis line Z is perpendicular to the ground plane HP and the face angle is 0°. The heel projection posture is shown in FIG. 2B and FIG. 5. In the heel projection posture, a heel-side portion of a sole is positioned considerably apart from the ground plane HP, and a toe-side portion of the sole or a toe-side portion of a side portion (skirt portion) is in contact with the ground plane HP. The heel projection posture is obtained by rotating a head which is in the reference state until the shaft axis line Z becomes perpendicular to the ground plane HP. By this rotation, the toe-heel direction of the head is inclined with respect to the ground plane HP (See FIG. 2A). However, in a planar view in which the head is viewed from above, the toe-heel direction of the head is not changed by this rotation. That is, in the heel projection posture, the face angle remains 0°.

A vector that extends in the toe-heel direction of a head which is in the heel projection posture can be decomposed into two vectors (components): a vector V1 that is parallel to the ground plane HP, and a vector V2 that is perpendicular to the ground plane HP (see FIG. 2B). The direction of the vector V1 parallel to the ground plane HP is defined as an inclined toe-heel direction. The inclined toe-heel direction is perpendicular to the shaft axis line Z. A heel side in the inclined toe-heel direction is also referred to as an inclined heel side. A toe side in the inclined toe-heel direction is also referred to as an inclined toe side. In FIG. 2B, an inclined heel direction is indicated by S-heel, and an inclined toe direction is indicated by S-toe.

The heel projection figure is a projected figure in which a head which is in the heel projection posture is viewed from the heel side along the ground plane HP. In other words, the heel projection figure is a figure obtained by projecting a head which is in the heel projection posture to the heel side along the inclined toe-heel direction. FIG. 5 is a heel projection figure.

Figure 3:
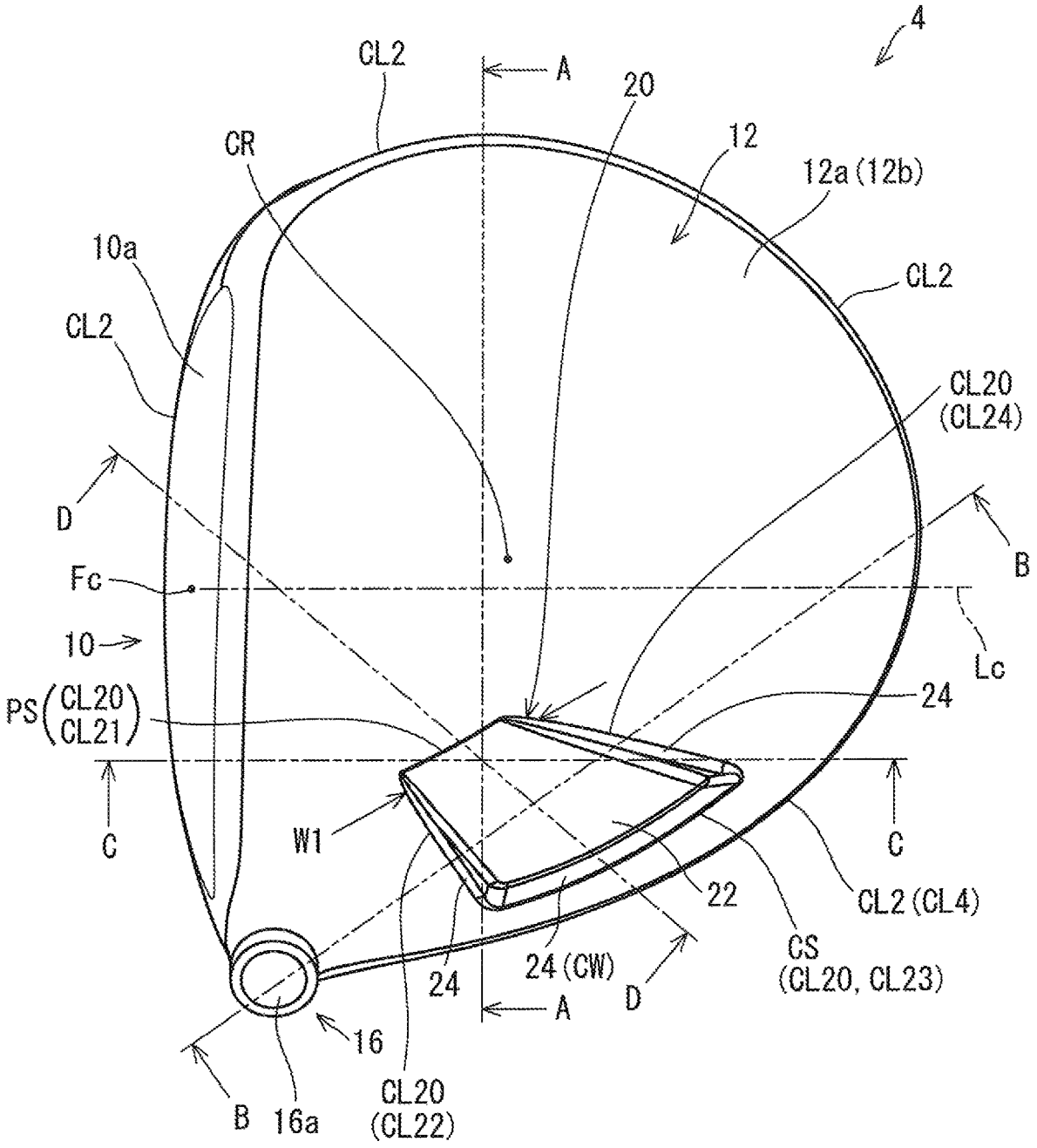
FIG. 3 is a plan view of the head of the first embodiment as viewed from a crown side.

FIG. 1 is an overall view of a golf club 2 that includes a head 4 according to one embodiment of the present disclosure. FIG. 2A is a front view of the head 4. FIG. 2A shows the head 4 which is in the reference state as viewed from the face side. FIG. 2B shows the head 4 which is in the heel projection posture as viewed from the face side. FIG. 3 is a plan view of the head 4 as viewed from the crown side. FIG. 4 is a side view of the head 4 as viewed from the heel side. FIG. 5 shows the head 4 as viewed from the inclined heel side. FIG. 5 is the heel projection figure of the head 4.

As shown in FIG. 1, the golf club 2 includes the golf club head 4, a shaft 6, and a grip 8. The shaft 6 has a tip end Tp and a butt end Bt. The head 4 is attached to a tip end portion of the shaft 6. The grip 8 is attached to a butt end portion of the shaft 6.

The golf club 2 is a driver (No. 1 wood). Typically, the club as a driver has a length of greater than or equal to 43 inches. Preferably, the golf club 2 is a wood-type golf club.

The shaft 6 is in a tubular form. The shaft 6 is hollow. The material of the shaft 6 is a carbon fiber reinforced resin. From the viewpoint of reducing the weight, a carbon fiber reinforced resin is preferable as a material for the shaft 6. The shaft 6 is a so-called carbon shaft. Preferably, the shaft 6 is formed with a cured prepreg sheet. In the prepreg sheet, fibers are substantially oriented in one direction. Such a prepreg in which fibers are substantially oriented in one direction is also referred to as UD prepreg. "UD" is an abbreviation of "unidirectional". A prepreg other than the UD prepreg may be used. For example, fibers contained in the prepreg sheet may be woven. The shaft 6 may include a metal wire. The material of the shaft 6 is not limited, and may be a metal, for example.

The grip 8 is a part that a golfer grips during a swing. Examples of the material of the grip 8 include rubber compositions and resin compositions. The rubber composition for the grip 8 may contain air bubbles.

Although not shown in the drawings, the head 4 is hollow. In the present embodiment, the head 4 is a wood type head. The head 4 may be a hybrid type (utility type) head. The head 4 may be an iron type head. The head 4 may be a putter type head. Examples of a preferable material for the head 4 include metals and fiber reinforced plastics. Examples of the metals include titanium alloys, pure titanium, stainless steel, maraging steel, and soft iron. Examples of the fiber reinforced plastics include carbon fiber reinforced plastics. The head 4 may be a composite head including a portion made of a metal and a portion made of a fiber reinforced plastic.

As shown in FIG. 2 to FIG. 5, the head 4 includes a face portion 10, a crown portion 12, a sole portion 14 and a hosel portion 16. The face portion 10 includes a striking face 10*a*. The striking face 10*a* is the outer surface of the face portion 10. The striking face 10*a* is also simply referred to as a face. The crown portion 12 forms a crown outer surface 12*a*. The sole portion 14 forms a sole outer surface 14*a*. The hosel portion 16 has a shaft hole 16*a*.

As shown in FIG. 1 and FIG. 4, the head 4 has a center of gravity CG (hereinafter also referred to as head center of gravity CG). In the present embodiment, the head center of gravity CG is positioned inside (in a hollow portion of) the head 4.

A double-pointed arrow B in FIG. 1 shows a distance of the center of gravity (hereinafter also referred to as gravity center distance) of the head 4. The gravity center distance B means a distance between the shaft axis line Z and the head center of gravity CG. The gravity center distance B is a distance measured in the front view of the head 4, not a distance measured three-dimensionally. The shaft axis line Z and the head center of gravity CG of the head which is in the reference state is projected to the reference perpendicular plane VP. The gravity center distance B is measured in this projected figure.

A double-pointed arrow C in FIG. 4 shows a depth of the center of gravity (hereinafter also referred to as gravity center depth) of the head 4. The gravity center depth C is a distance between the shaft axis line Z and the head center of gravity CG. The gravity center depth C is measured in the face-back direction.

The striking face 10*a* has a face center Fc as defined above.

The head center of gravity CG of the head 4 is not positioned on the shaft axis line Z. The head center of gravity CG is positioned apart of the shaft axis line Z. The head 4 has the gravity center distance B and the gravity center depth C. These gravity center distance B and gravity center depth C are causes of the toe down phenomenon.

The crown portion 12 includes a protruding portion 20 on the crown outer surface 12*a*. The protruding portion 20 is hollow. The protruding portion 20 forms a projection on the crown outer surface 12*a* and forms a recess on a crown inner surface.

In the front view of the head as viewed from the face side (see FIG. 2A), the protruding portion 20 is not viewable. In the front view of the head as viewed from the face side (see FIG. 2A), the protruding portion 20 does not form any part of an outer contour line CL1 of the head 4.

In the present embodiment, the entirety of the protruding portion 20 is formed on the crown outer surface 12*a*. As shown in FIG. 3, the head 4 has an outer contour line CL2 in the plan view of the head 4. As shown in FIG. 3, the protruding portion 20 does not reach the outer contour line CL2. The protruding portion 20 does not extend to other portions than the crown outer surface 12*a*.

The plan view of the head 4 is a projected figure obtained by projecting the head which is in the reference state onto a plane parallel to the ground plane HP. This plan view (FIG. 3) is also referred to as a planar view.

In the plan view (FIG. 3) of the head 4, the protruding portion 20 may reach the outer contour line CL2. In other words, the protruding portion 20 may form a part of the outer contour line CL2. The protruding portion 20 may extend into other portions than the crown outer surface 12*a*. For example, the protruding portion 20 may extend from the crown outer surface 12*a* onto the sole outer surface 14*a*. For example, the protruding portion 20 may extend from the crown outer surface 12*a* onto the outer surface of a side portion (skirt portion).

In the side view (FIG. 4) of the head 4 which is in the reference state as viewed from the heel side in the toe-heel direction, the entirety of the protruding portion 20 can be seen. This side view shows an outer contour line CL3 of the crown outer surface 12*a*. In this side view, the protruding portion 20 does not reach the outer contour line CL3. The entirety of the protruding portion 20 is positioned on the heel side with respect to the face center Fc. A part of the protruding portion 20 may reach the toe side with respect to the face center Fc.

The crown outer surface 12*a* includes a crown base surface 12*b*. Of the crown outer surface 12*a*, a portion in which the protruding portion 20 is not present is formed by the crown base surface 12*b*. The crown base surface 12*b* is a convex curved surface that is smooth and continuous. The convex curved surface is a curved surface that is convex toward the outside of the head 4. As shown in FIG. 3, the crown base surface 12*b* includes a geometric center CR of the head 4 in the plan view. The geometric center CR is the geometric center of a figure indicated by the outer contour line CL2.

Figure 6:
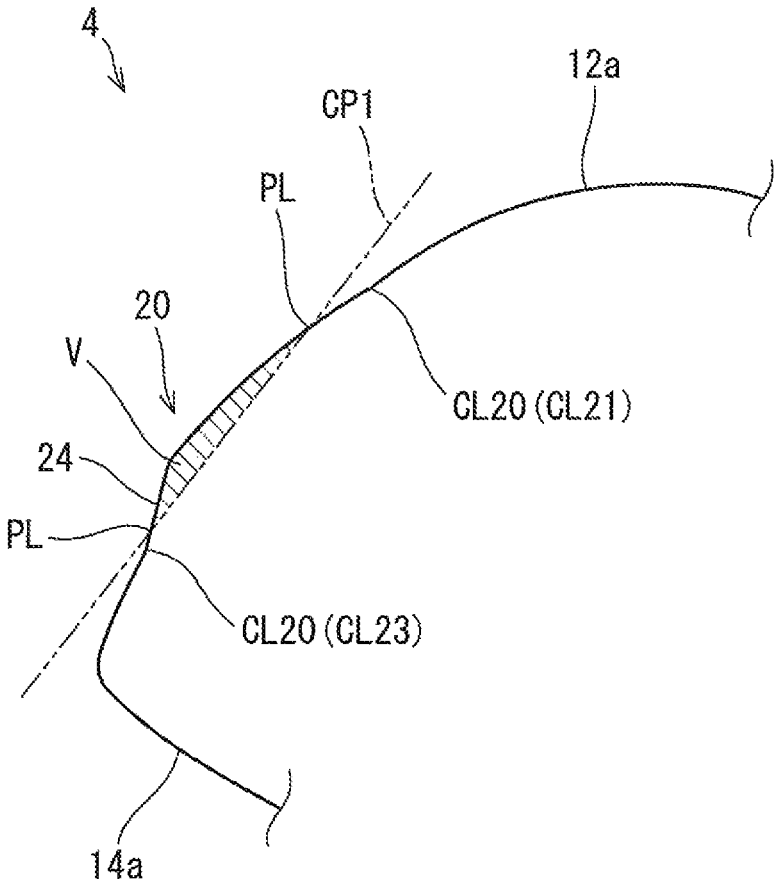
FIG. 6 shows a part of an outer contour line of the head of the first embodiment as viewed from a toe-back side.
Figure 7:
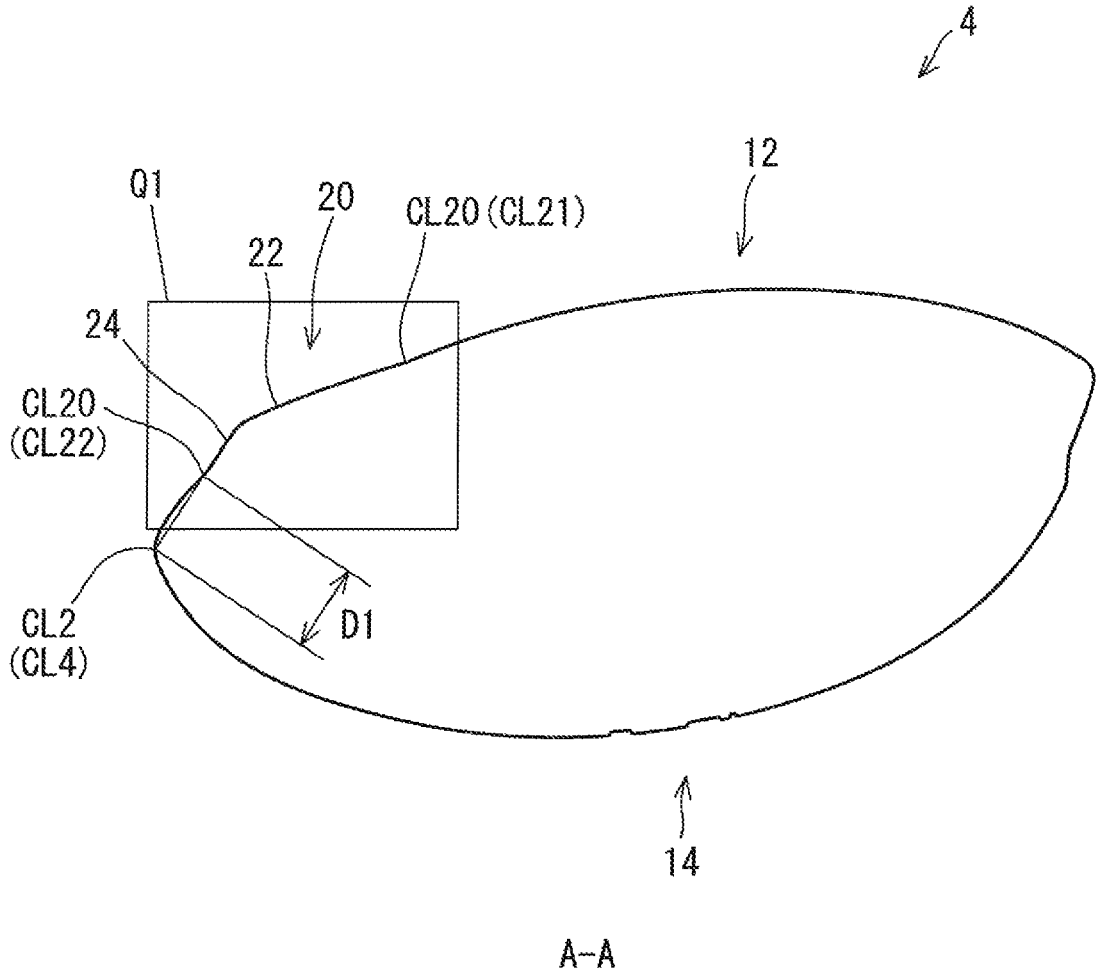
FIG. 7 shows a cross-sectional contour line of the outer surface of the head in a cross-sectional view taken along line A-A in FIG. 3.
Figure 8:
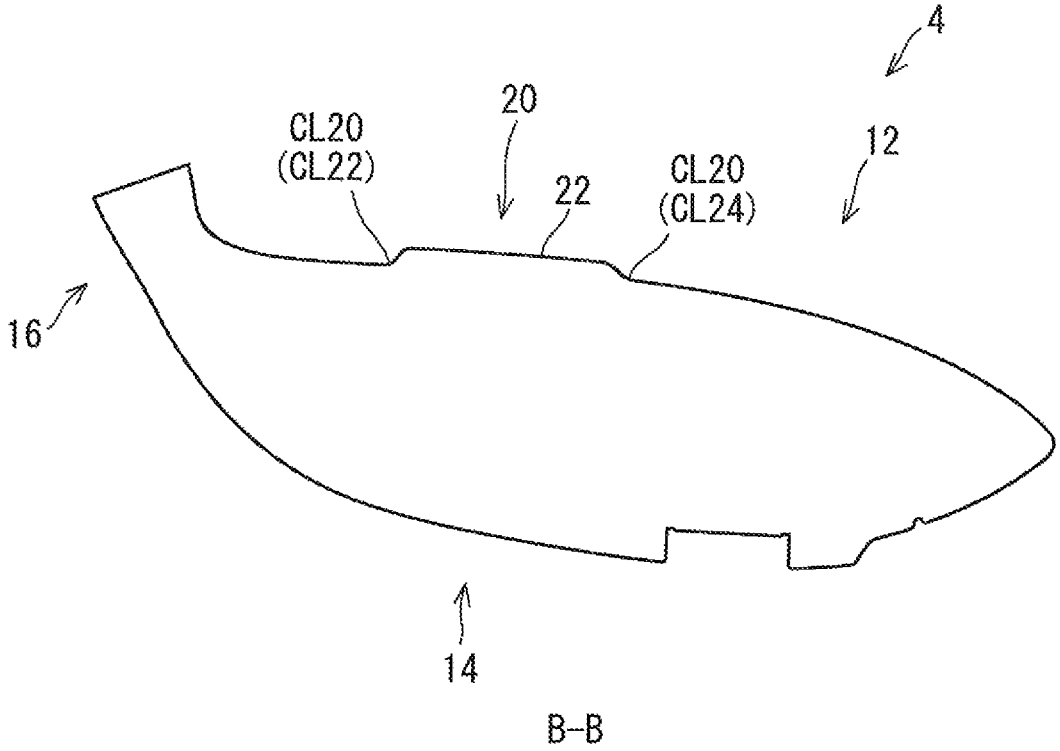
FIG. 8 shows a cross-sectional contour line of the outer surface of the head in a cross-sectional view taken along line B-B in FIG. 3.
Figure 9:
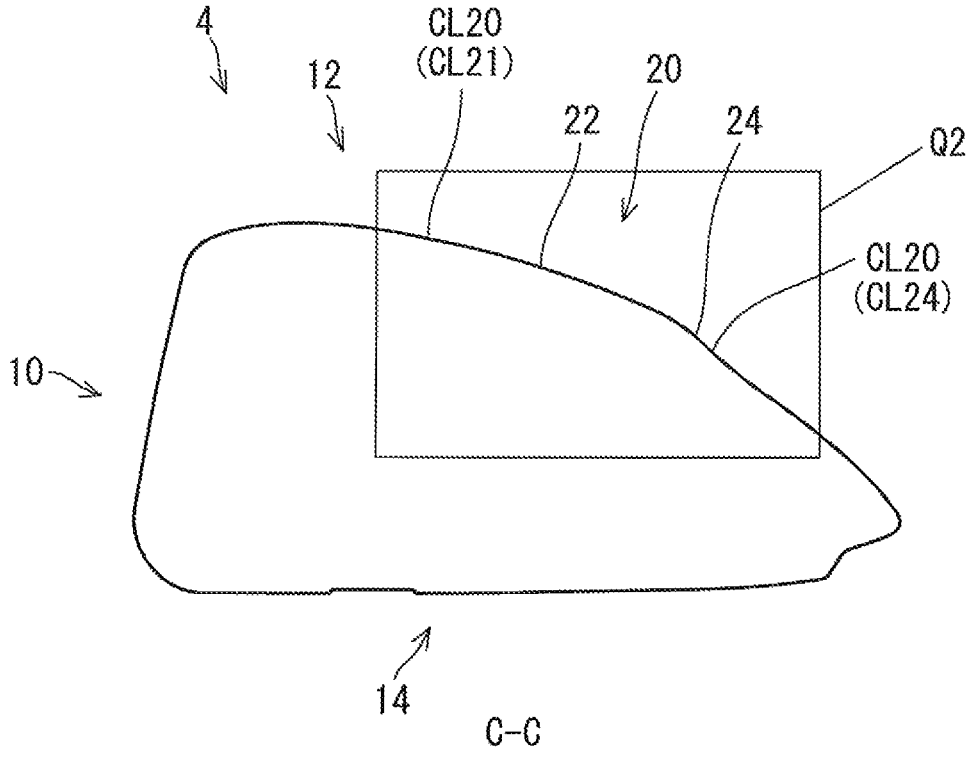
FIG. 9 shows a cross-sectional contour line of the outer surface of the head in a cross-sectional view taken along line C-C in FIG. 3.
Figure 10:
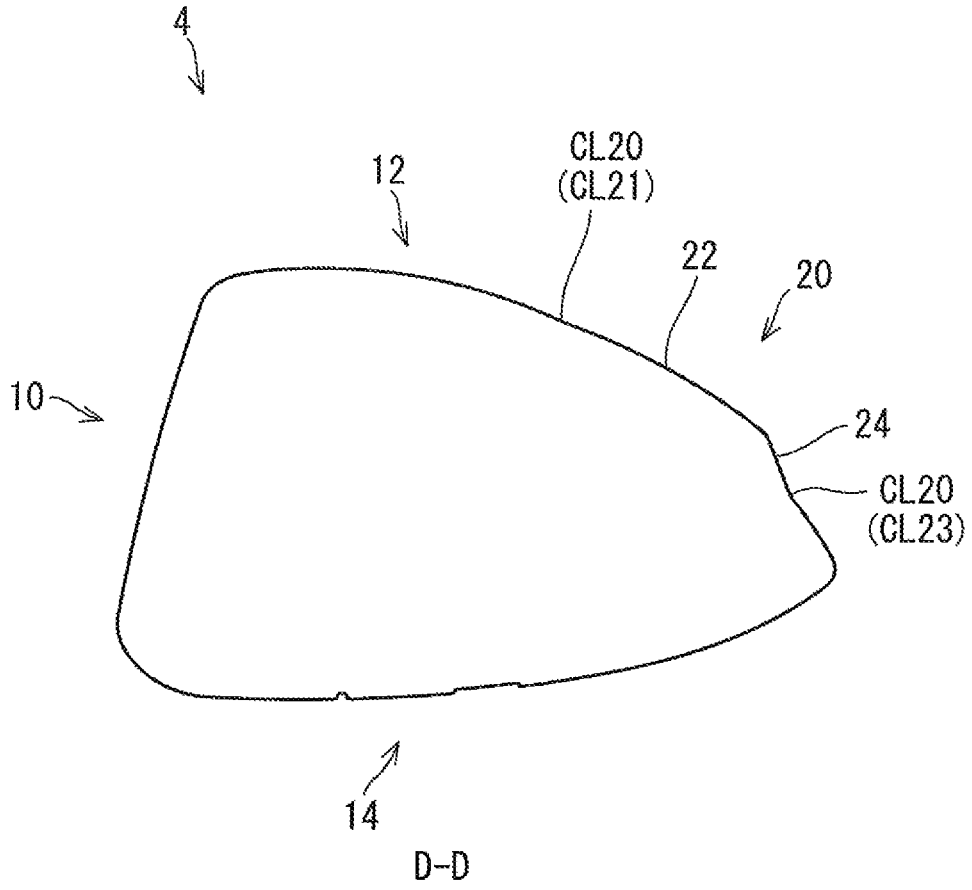
FIG. 10 shows a cross-sectional contour line of the outer surface of the head in a cross-sectional view taken along line D-D in FIG. 3.

FIG. 6 shows a part of an outer contour line of the head 4 as viewed from the toe side. FIG. 7 shows a cross-sectional contour line of the outer surface of the head 4 in a cross-sectional view taken along line A-A in FIG. 3. FIG. 8 shows a cross-sectional contour line of the outer surface of the head 4 in a cross-sectional view taken along line B-B in FIG. 3. FIG. 9 shows a cross-sectional contour line of the outer surface of the head 4 in a cross-sectional view taken along line C-C in FIG. 3. FIG. 10 shows a cross-sectional contour line of the outer surface of the head 4 in a cross-sectional view taken along line D-D in FIG. 3. Each of FIG. 7 to FIG. 10 includes a cross-sectional contour line of the crown outer surface 12*a*.

The protruding portion 20 includes a contour line CL20, an upper surface 22, and a sidewall surface 24. The contour line CL20 is a boundary line between the crown base surface 12*b* and the protruding portion 20. In the plan view of the head 4 (FIG. 3), the contour line CL20 of the protruding portion 20 has a substantially quadrilateral shape (substantially trapezoidal shape). In the present disclosure, the word "substantially" means that a shape in question may have a curved side(s) (not straight side(s)) and/or a rounded angle(s). In the contour line CL20 in the plan view of the head (FIG. 3), the radius of curvature of the curved side(s) is preferably greater than or equal to 25 mm, more preferably greater than or equal to 40 mm, and still more preferably greater than or equal to 50 mm. In the contour line CL20 in the plan view of the head (FIG. 3), the radius of curvature of the rounded angle(s) is preferably less than or equal to 10 mm, more preferably less than or equal to 7 mm, and still more preferably less than or equal to 5 mm. The contour line CL20 forms the substantially quadrilateral shape.

The boundary between the upper surface 22 and the sidewall surface 24 can be defined by a ridgeline. In a cross-sectional contour line of the outer surface of the protruding portion 20, the ridgeline can be specified as a vertex of an angle or a point having a radius of curvature of less than or equal to 5 mm. Although the radius of curvature of the cross-sectional contour line of the outer surface of the protruding portion 20 can vary depending on the direction of the cross section, a cross section that has the smallest radius of curvature is selected for determining the radius of curvature to specify the ridgeline.

In the plan view (planar view) of the head 4, the protruding portion 20 can have a substantially polygonal shape. When this substantially polygonal shape is defined as a substantially N-sided polygonal shape, N can be an integer of greater than or equal to 3. N may be an integer that is greater than or equal to 3 and less than or equal to 20.

The contour line CL20 has a first side CL21, a second side CL22, a third side CL23 and a fourth side CL24. The first side CL21 constitutes a side on the toe-face side of the protruding portion 20. The first side CL21 extends toward the back side as it goes to the toe side. The first side CL21 connects the second side CL22 and the fourth side CL24.

The second side CL22 constitutes a side on the heel-face side of the protruding portion 20. The second side CL22 extends toward the back side as it goes to the heel side. The second side CL22 connects the first side CL21 and the third side CL23.

The third side CL23 constitutes a side on the heel-back side of the protruding portion 20. The third side CL23 extends toward the back side as it goes to the toe side. The third side CL23 connects the second side CL22 and the fourth side CL24. The third side CL23 constitutes a curved line that projects toward the outside of the head 4.

The fourth side CL24 constitutes a side on the toe-back side of the protruding portion 20. The fourth side CL24 extends toward the back side as it goes to the heel side. The fourth side CL24 connects the third side CL23 and the first side CL21.

The second side CL22, the third side CL23, and the fourth side CL24 constitute a starting line of the sidewall surface 24. That is, the second side CL22, the third side CL23, and the fourth side CL24 constitute the boundary line between the sidewall surface 24 and the crown base surface 12*b*. On the other hand, the first side CL21 does not constitute a starting line of the sidewall surface 24. The first side CL21 constitutes the boundary line between the crown base surface 12*b* and the upper surface 22.

In the present disclosure, a cross-sectional contour line in a cross section taken along the toe-heel direction is also simply referred to as a t-h cross-sectional contour line. FIG. 7 shows one example of the t-h cross-sectional contour line. The t-h cross-sectional contour line of the crown outer surface 12*a* is also referred to as a crown t-h cross-sectional contour line. FIG. 7 includes the crown t-h cross-sectional contour line. In the present disclosure, a cross-sectional contour line in a cross section taken along the face-back direction is also simply referred to as a f-b cross-sectional contour line. FIG. 9 shows one example of the f-b cross-sectional contour line. The f-b cross-sectional contour line of the crown outer surface 12*a* is also referred to as a crown f-b cross-sectional contour line. FIG. 9 includes the crown f-b cross-sectional contour line.

An inflection point of the crown t-h cross-sectional contour line can be a point that forms the contour line CL20. In other words, this inflection point can be a starting point of the protruding portion 20. The t-h cross-sectional contour line of the crown base surface 12*b* is a curved line that projects toward the outside of the head 4. The inflection point is a point at which the curved line that projects toward the outside of the head 4 changes into a curved line that projects toward the inside of the head 4.

A vertex of an angle of the crown t-h cross-sectional contour line can be a point that forms the contour line CL20. In other words, this vertex can be a starting point of the protruding portion 20. The t-h cross-sectional contour line of the crown base surface 12*b* is a curved line that projects toward the outside of the head 4. A line that is connected to this curved line, bends, and extends toward the outside of the head 4 forms a vertex. This vertex points toward the inside of the head 4. This vertex can be a starting point of the protruding portion 20.

An inflection point of the crown f-b cross-sectional contour line can be a point that forms the contour line CL20. In other words, this inflection point can be a starting point of the protruding portion 20. The f-b cross-sectional contour line of the crown base surface 12*b* is a curved line that projects toward the outside of the head 4. The inflection point is a point at which the curved line that projects toward the outside of the head 4 changes into a curved line that projects toward the inside of the head 4.

A vertex of an angle of the crown f-b cross-sectional contour line can be a point that forms the contour line CL20. In other words, this vertex can be a starting point of the protruding portion 20. The f-b cross-sectional contour line of the crown base surface 12*b* is a curved line that projects toward the outside of the head 4. A line that is connected to this curved line, bends, and extends toward the outside of the head 4 forms a vertex. This vertex points toward the inside of the head 4. This vertex can be a starting point of the protruding portion 20.

Typically, the contour line CL20 can be determined by the inflection points or the vertices. For determining the contour line CL20, the crown t-h cross-sectional contour line may be selected in preference to the crown f-b cross-sectional contour line. In this case, the crown t-h cross-sectional contour line is used for specifying the inflection point or the vertex. When it is difficult to specify the inflection point or the vertex by using the crown t-h cross-sectional contour line, the crown f-b cross-sectional contour line can be used. When the contour line of the protruding portion 20 can be visually and clearly recognized, the contour line can be determined as the contour line CL20.

The protruding portion 20 is a portion that protrudes from the crown base surface 12*b*. A virtually extended surface 12*c* that is obtained by extending the crown base surface 12*b* can be specified on the lower side of the protruding portion 20. The protruding portion 20 is a portion that protrudes relative to the virtually extended surface 12*c*. The virtually extended surface 12*c* can be considered as a part of the crown base surface 12*b* formed in a region in which the protruding portion 20 is formed if the protruding portion 20 is not present. The virtually extended surface 12*c* is formed so as to be continuous with the crown base surface 12*b*. The virtually extended surface 12*c* is a curved surface that is convex toward the outside of the head 4. The virtually extended surface 12*c* is smoothly continuous with the crown base surface 12*b*.

Figure 11:
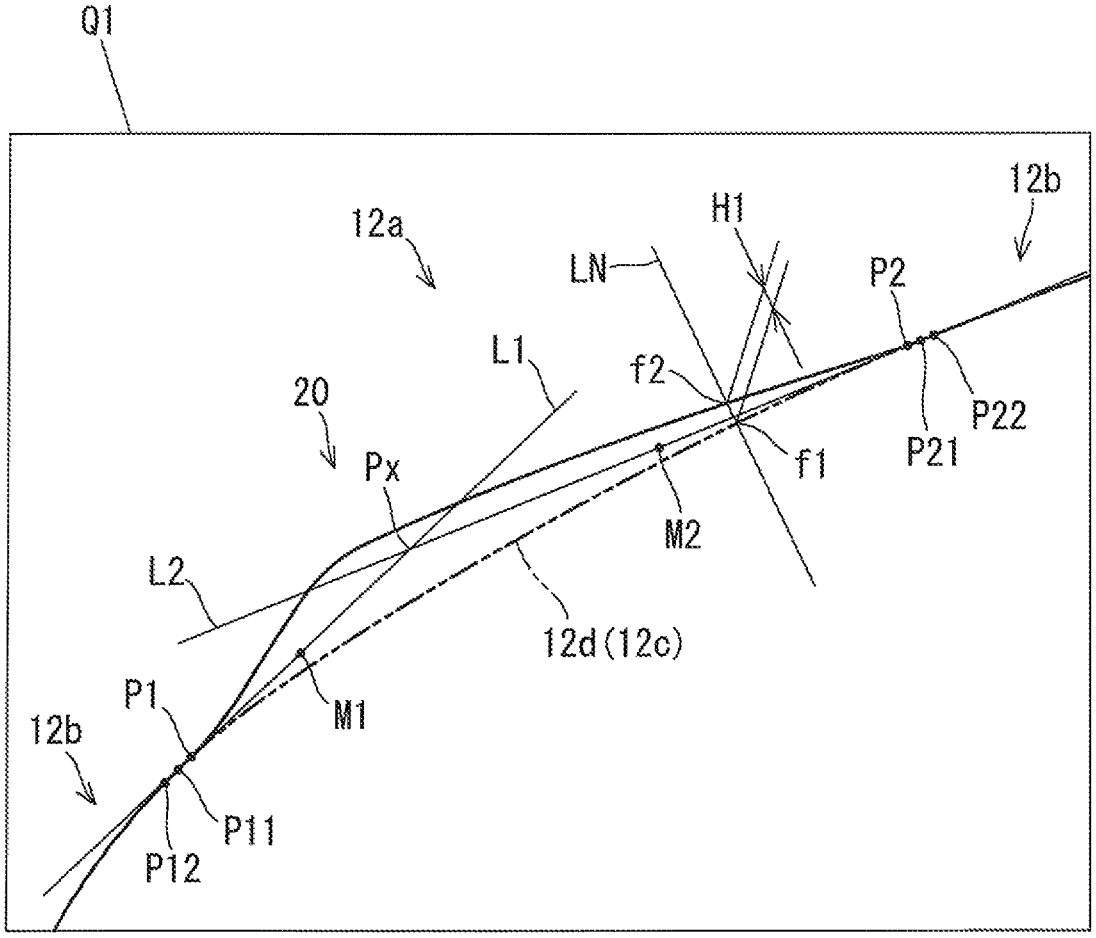
FIG. 11 is an enlarged view of a portion surrounded by a tetragon Q1 in FIG. 7, and a virtually extended line of a crown base surface is additionally drawn in FIG. 11.
Figure 12:
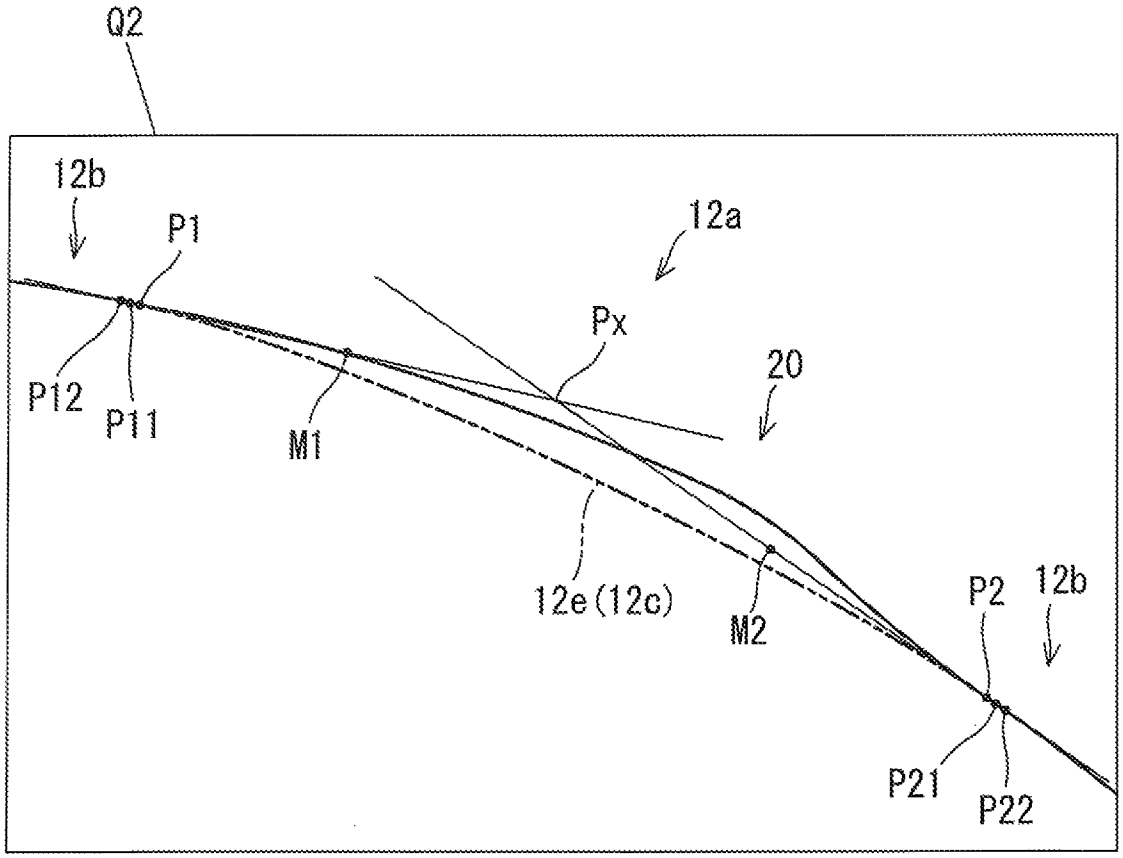
FIG. 12 is an enlarged view of a portion surrounded by a tetragon Q2 in FIG. 9, and a virtually extended line of the crown base surface is additionally drawn in FIG. 12.

FIG. 11 is an enlarged view of a portion that is surrounded by a tetragon Q1 in FIG. 7. FIG. 12 is an enlarged view of a portion that is surrounded by a tetragon Q2 in FIG. 9.

FIG. 11 shows the crown t-h cross-sectional contour line with a virtually extended line 12*d* that can form the virtually extended surface 12*c*. The virtually extended line 12*d* is a curved surface that is convex toward the outside of the head 4. The virtually extended line 12*d* is smoothly continuous with the t-h cross-sectional contour line of the crown base surface 12*b*. The virtually extended surface 12*c* can be formed by a set of virtually extended lines 12*d*.

The virtually extended line 12*d* smoothly connects one side end of the t-h cross-sectional contour line of the protruding portion 20 and the other side end of the t-h cross-sectional contour line of the protruding portion 20. The virtually extended line 12*d* can be drawn as a Bezier curve. A quadratic Bezier curve and a cubic Bezier curve are known as the Bezier curve. In the quadratic Bezier curve, the number of control points is one (excluding a starting point and an end point). In the cubic Bezier curve, the number of control points is two (excluding a starting point and an end point). The cubic Bezier curve is preferably used. Bezier curves drawn in FIG. 11 and FIG. 12 are cubic Bezier curves.

As shown in FIG. 11, the crown t-h cross-sectional contour line has a first starting point P1 and a second starting point P2. The first starting point P1 and the second starting point P2 are located on the contour line CL20.

Points P11 and P12 that are located on the opposite side of the first starting point P1 from the protruding portion 20 are plotted in order to define an effective tangent line to the crown t-h cross-sectional contour line at the first starting point P1. The point P11 is a point located 0.5 mm apart from the first starting point P1. The point P12 is a point located 0.5 mm apart from the point P11. "0.5 mm" for these points is a route length measured along the crown t-h cross-sectional contour line. The points P11 and P12 are located on the crown t-h cross-sectional contour line. A tangent line L1 to a circle that passes through these three points P1, P11 and P12 at the point P1 is determined. When the points P1, P11 and P12 are positioned on a single straight line, this straight line can be determined as the tangent line L1.

Similarly, points P21 and P22 that are located on the opposite side of the second starting point P2 from the protruding portion 20 are plotted in order to define an effective tangent line to the crown t-h cross-sectional contour line at the second starting point P2. The point P21 is a point located 0.5 mm apart from the second starting point P2. The point P22 is a point located 0.5 mm apart from the point P21. "0.5 mm" for these points is a route length measured along the crown t-h cross-sectional contour line. The points P21 and P22 are located on the crown t-h cross-sectional contour line. A tangent line L2 to a circle that passes through these three points P2, P21 and P22 at the point P2 is determined. When the points P2, P21 and P22 are positioned on a single straight line, this straight line can be determined as the tangent line L2.

When the tangent line L1 and the tangent line L2 are determined, then an intersection point Px between the tangent line L1 and the tangent line L2 is specified. Furthermore, a middle point M1 between the point P1 and the point Px is specified, and a middle point M2 between the point P2 and the point Px is specified.

A Bezier curve can be drawn by using the point P1 as the starting point, the middle point M1 as the first control point, the middle point M2 as the second control point, and the point P2 as the end point. In FIG. 11, a Bezier curve drawn in this manner is the virtually extended line 12*d*. Because of having two control points, this Bezier curve is a cubic Bezier curve.

The virtually extended line 12*d* can be defined at any position in the face-back direction. The virtually extended surface 12*c* can be defined as the set of these virtually extended lines 12*d*.

A similar Bezier curve can be defined in the crown f-b cross-sectional contour line. As shown in FIG. 12, the crown f-b cross-sectional contour line has a first starting point P1 and a second starting point P2. The first starting point P1 and the second starting point P2 are located on the contour line CL20.

Points P11 and P12 that are located on the opposite side of the first starting point P1 from the protruding portion 20 are plotted in order to define an effective tangent line to the crown f-b cross-sectional contour line at the first starting point P1. The point P11 is a point located 0.5 mm apart from the first starting point P1. The point P12 is a point located 0.5 mm apart from the point P11. "0.5 mm" for these points is a route length measured along the crown f-b cross-sectional contour line. The points P11 and P12 are located on the crown f-b cross-sectional contour line. A tangent line L1 to a circle that passes through these three points P1, P11 and P12 at the point P1 is determined. When the points P1, P11 and P12 are positioned on a single straight line, this straight line can be determined as the tangent line L1.

Similarly, points P21 and P22 that are located on the opposite side of the second starting point P2 from the protruding portion 20 are plotted in order to define an effective tangent line to the crown f-b cross-sectional contour line at the second starting point P2. The point P21 is a point located 0.5 mm apart from the second starting point P2. The point P22 is a point located 0.5 mm apart from the point P21. "0.5 mm" for these points is a route length measured along the crown f-b cross-sectional contour line. The points P21 and P22 are located on the crown f-b cross-sectional contour line. A tangent line L2 to a circle that passes through these three points P2, P21 and P22 at the point P2 is determined. When the points P2, P21 and P22 are positioned on a single straight line, this straight line can be determined as the tangent line L2.

When the tangent line L1 and the tangent line L2 are determined, then an intersection point Px between the tangent line L1 and the tangent line L2 is specified. Furthermore, a middle point M1 between the point P1 and the point Px is specified, and a middle point M2 between the point P2 and the point Px is specified.

A Bezier curve can be drawn by using the point P1 as the starting point, the middle point M1 as the first control point, the middle point M2 as the second control point, and the point P2 as the end point. In FIG. 12, a Bezier curve drawn in this manner is a virtually extended line 12*e*.

The virtually extended line 12*e* can be defined at any position in the toe-heel direction. The virtually extended surface 12*c* can be defined as the set of these virtually extended lines 12*e*.

In another embodiment, the protruding portion may reach an outer peripheral edge (outer contour line CL4) of the crown portion (see FIG. 19B explained below). In this case, the number of the starting point(s) of the protruding portion which is/are formed on the boundary between the protruding portion and the crown base surface 12*b* can be only one in the crown t-h cross-sectional contour line and/or the crown f-b cross-sectional contour line. When only one starting point is present as in this case, a circular arc that is drawn so as to path through the starting point and have a radius of curvature at the starting point can be the virtually extended line 12*d*. That is, in this case, the virtually extended line 12*d* can be a circle that passes through the following three points: a first point that is the starting point; a second point located 0.5 mm apart from the first point; and a third point located 0.5 mm apart from the second point.

For determining the virtually extended surface 12*c*, the crown t-h cross-sectional contour line may be used in preference to the crown f-b cross-sectional contour line. The virtually extended surface 12*c* can be determined as a set of the virtually extended lines 12*d* obtained from the crown t-h cross-sectional contour lines. When the virtually extended surface 12*c* is not clearly determined by the set of the virtually extended lines 12*d*, the virtually extended surface 12*c* may be determined as a set of the virtually extended lines 12*e* obtained from the crown f-b cross-sectional contour lines.

A height H1 of the protruding portion 20 can be defined as a height from the virtually extended surface 12*c*. As shown in FIG. 11, a normal line LN that is normal to the virtually extended surface 12*c* at a certain point f1 has an intersection point f2 at which the normal line LN intersects the outer surface of the protruding portion 20. A distance between the point f1 and the intersection point f2 can be defined as the height H1 of the protruding portion 20 at the intersection point f2. If the protruding portion does not intersect the normal line LN of the virtually extended surface 12*c* and has a point at which the protruding portion intersects a normal line that is normal to the crown base surface 12*b*, the height H1 of the protruding portion at the point is defined as a height from the crown base surface 12*b*. Also in this case, the length of the normal line is the height H1.

Figure 13A:
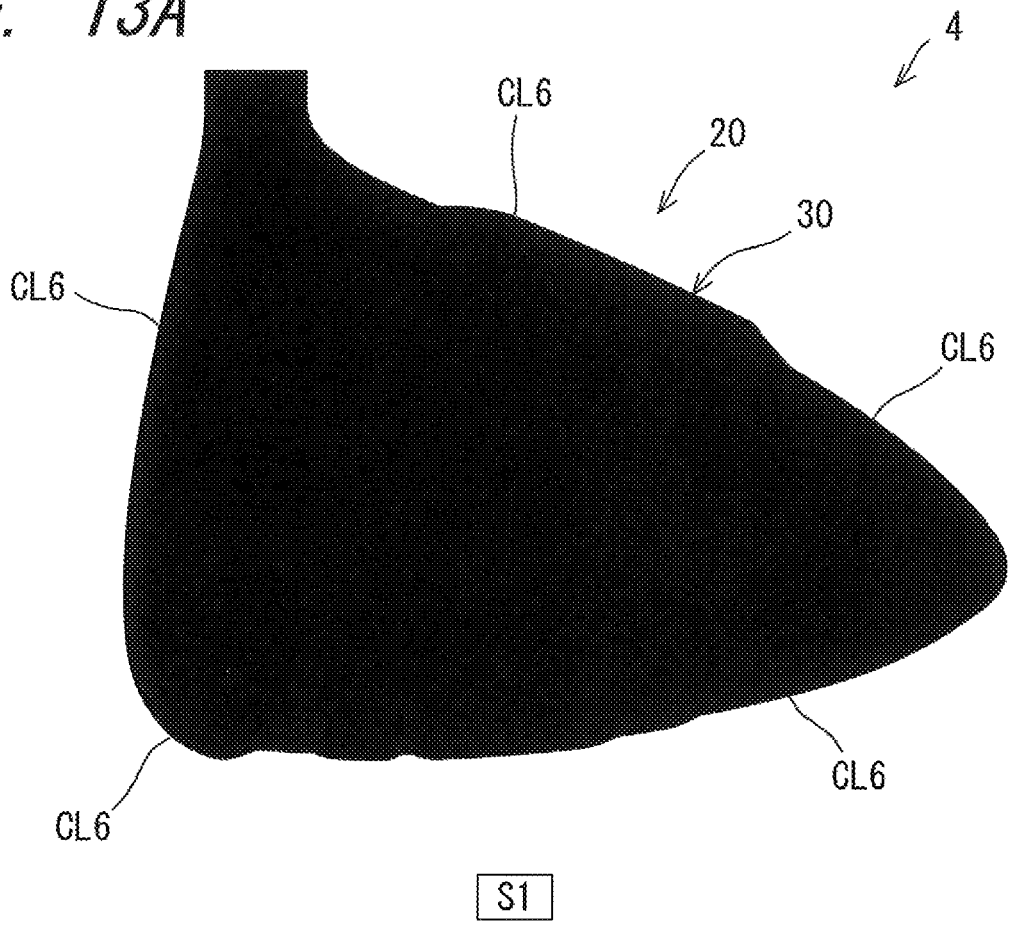
FIG. 13A shows a silhouette of the heel projection figure in FIG. 5.
Figure 13B:
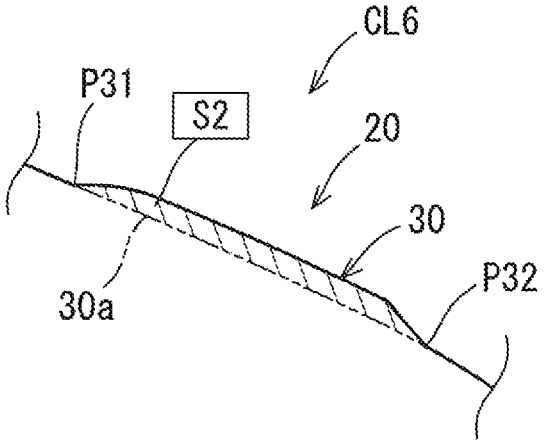
FIG. 13B shows a part of the contour line of the silhouette, FIG. 13B showing a part of the outer contour line of the heel projection figure of the head of the first embodiment.

FIG. 13A shows a silhouette of the heel projection figure in FIG. 5. FIG. 13B shows a part of the contour line of the silhouette. The contour line of the silhouette is an outer contour line CL6 of the heel projection figure of the head 4. FIG. 13B is a part of the outer contour line CL6 of the heel projection figure of the head 4.

In the heel projection figure of the head 4, the outer contour line CL6 of the crown outer surface includes a protuberance 30. The protuberance 30 is also referred to as a silhouette protuberance. As described above, the protruding portion 20 can be seen in the heel projection figure (FIG. 5). The silhouette protuberance 30 is formed by the protruding portion 20. A silhouette area S1 is enlarged by the presence of the silhouette protuberance 30. That is, the protruding portion 20 enlarges the silhouette area S1 of the heel projection figure. The silhouette area S1 means the area of the figure formed by the outer contour line CL6 of the heel projection figure, which is also the area of the silhouette shown in FIG. 13A.

An inflection point of the outer contour line CL6 of the heel projection figure can be a starting point of the silhouette protuberance. A vertex of an angle of the outer contour line CL6 of the heel projection figure can be a starting point of the silhouette protuberance. In the present embodiment, vertices, not inflection points, located on both sides of the silhouette protuberance 30 are the starting points of the silhouette protuberance 30. As shown in FIG. 13B, in the silhouette protuberance 30 of the present embodiment, vertices P31 and P32 of angles are the starting points of the silhouette protuberance 30.

A cubic Bezier curve can be drawn also for the silhouette protuberance 30 in the same manner as discussed above. A two-dot chain line in FIG. 13B shows the Bezier curve. This Bezier curve is a curved line that smoothly connects curved lines adjacent to both ends of the silhouette protuberance 30. This Bezier curve can be a virtual contour line 30*a* of the heel projection figure when the protruding portion 20 is not present. An area of a portion surrounded by the contour line of the silhouette protuberance 30 and the virtual contour line 30*a* is defined as an additional area S2 added by the protruding portion 20. In the present embodiment, the additional area S2 is the area of a portion indicated with hatching in FIG. 13B. Of the silhouette area S1, an area increased by the protruding portion 20 is the additional area S2.

Although the protruding portion forms a part of the outer contour line CL6 of the head in the heel projection figure in this case, there is a case where the silhouette protuberance is not formed. For example, when the protruding portion reaches the outer peripheral edge (outer contour line CL4) of the crown portion and extends along the outer peripheral edge, the silhouette protuberance might not be formed. However, also in such a case, the protruding portion is viewable in the heel projection figure, and increases the silhouette area S1. That is, also in this case, the additional area S2 added by the protruding portion is present. For example, a silhouette area S11 of a head in which the protruding portion is replaced by the virtually extended surface 12*c* and the protruding portion is removed, and a silhouette area S12 of a head having the protruding portion can be considered. An area (S12-S11) can be considered as the additional area S2.

From the viewpoint of suppression of the toe down and stabilization, the additional area S2 is preferably greater than or equal to 30 $mm^2$, more preferably greater than or equal to 50 $mm^2$, and still more preferably greater than or equal to 100 $mm^2$. From the viewpoint of lowering air resistance at a position 6, there is a limit on the height and the volume of the protruding portion. From this viewpoint, the additional area S2 is preferably less than or equal to 500 $mm^2$, more preferably less than or equal to 400 $mm^2$, and still more preferably less than or equal to 300 $mm^2$.

From the viewpoint of suppression of the toe down and stabilization, a ratio (S2/S1) is preferably greater than or equal to 0.005, more preferably greater than or equal to 0.008, and still more preferably greater than or equal to 0.015. From the viewpoint of lowering air resistance at the position 6, there is a limit on the height and the volume of the protruding portion. From this point of view, the ratio (S2/S1) is preferably less than or equal to 0.10, more preferably less than or equal to 0.08, and still more preferably less than or equal to 0.06. S2/S1 is the ratio of the additional area S2 to the silhouette area S1.

With reference to FIG. 6, an intersection line PL between the crown outer surface 12*a* and a plane forms a closed figure. This plane is referred to as a crown cut plane. In FIG. 6, this crown cut plane CP1 is indicated by a two-dot chain line. Although not shown in the side view of FIG. 6, in the planar view, the intersection line PL between the crown outer surface 12*a* and the crown cut plane CP1 forms a closed figure on the crown cut plane CP1. The intersection line PL is a line having an endless annular shape. Since FIG. 6 is a side view, the intersection line PL is shown as points.

The crown outer surface 12*a* is cut off by the crown cut plane CP1. An object whose outer surface is constituted by the cutoff crown outer surface 12*a* and the crown cut plane CP1 is referred to as a cutoff object. The volume of the cutoff object is referred to as a cutoff volume. The length of the intersection line PL is defined as L (mm), and the cutoff volume is defined as V ($mm^3$). The length L is the length of the intersection line PL measured as it is. In other words, the length L is the route length of the intersection line PL. For example, when the protruding portion has a conical shape, and the crown cut plane CP1 cuts the conical shape so that the intersection line PL forms a circle, then the length L is the length of the circumference of the circle. In the embodiment of FIG. 3, the intersection line PL can have an endless substantially quadrilateral shape. In this case, the length L is the route length of the intersection line PL having this substantially quadrilateral shape.

A ratio (V/L) can be an index indicating the degree of protrusion of the crown outer surface 12*a*. The greater the ratio (V/L) is, the greater the degree of protrusion is. The crown outer surface 12*a* preferably includes a portion having a ratio (V/L) of greater than a threshold X. In other words, it is preferable that a crown cut plane CP1 can be set in the crown outer surface 12*a* such that the ratio (V/L) is greater than the threshold X.

A portion having a ration (V/L) of greater than the threshold X can forms at least a part of the protruding portion 20. Preferably, the entirety of the intersection line PL in which the ratio (V/L) is greater than the threshold X constitutes the intersection line between the protruding portion 20 and the crown cut plane CP1. In other words, it is preferable that a crown cut plane CP1 can be set in the protruding portion 20 such that the ratio (V/L) is greater than the threshold X. The crown cut plane CP1 shown in FIG. 6 is also set at a position where the entirety of the intersection line PL is the intersection line between the protruding portion 20 and the crown cut plane CP1. The ratio of the maximum value of the cutoff volume V to the volume of the protruding portion 20 when the entirety of the intersection line PL is the intersection line between the protruding portion 20 and the crown cut plane CP1 is preferably greater than or equal to 50%, more preferably greater than or equal to 60%, and still more preferably greater than or equal to 70%. Note that the volume of the protruding portion 20 can be considered as the volume of a portion cut off by the virtually extended surface 12*c*. When the entirety of the intersection line PL is the intersection line between the protruding portion 20 and the crown cut plane CP1, the crown cut plane CP1 may also intersect the virtually extended surface 12*c*.

From the viewpoint of increasing the degree of protrusion of the protruding portion 20 and increasing the additional area S2 of the heel projection figure, the threshold X is preferably greater than or equal to 20, more preferably greater than or equal to 30, and still more preferably greater than or equal to 40. An excessively great degree of protrusion may cause a golfer to feel a sense of incongruity in the shape of the head. From this viewpoint, the threshold X is preferably less than or equal to 500, more preferably less than or equal to 450, and still more preferably less than or equal to 400.

Figure 14:
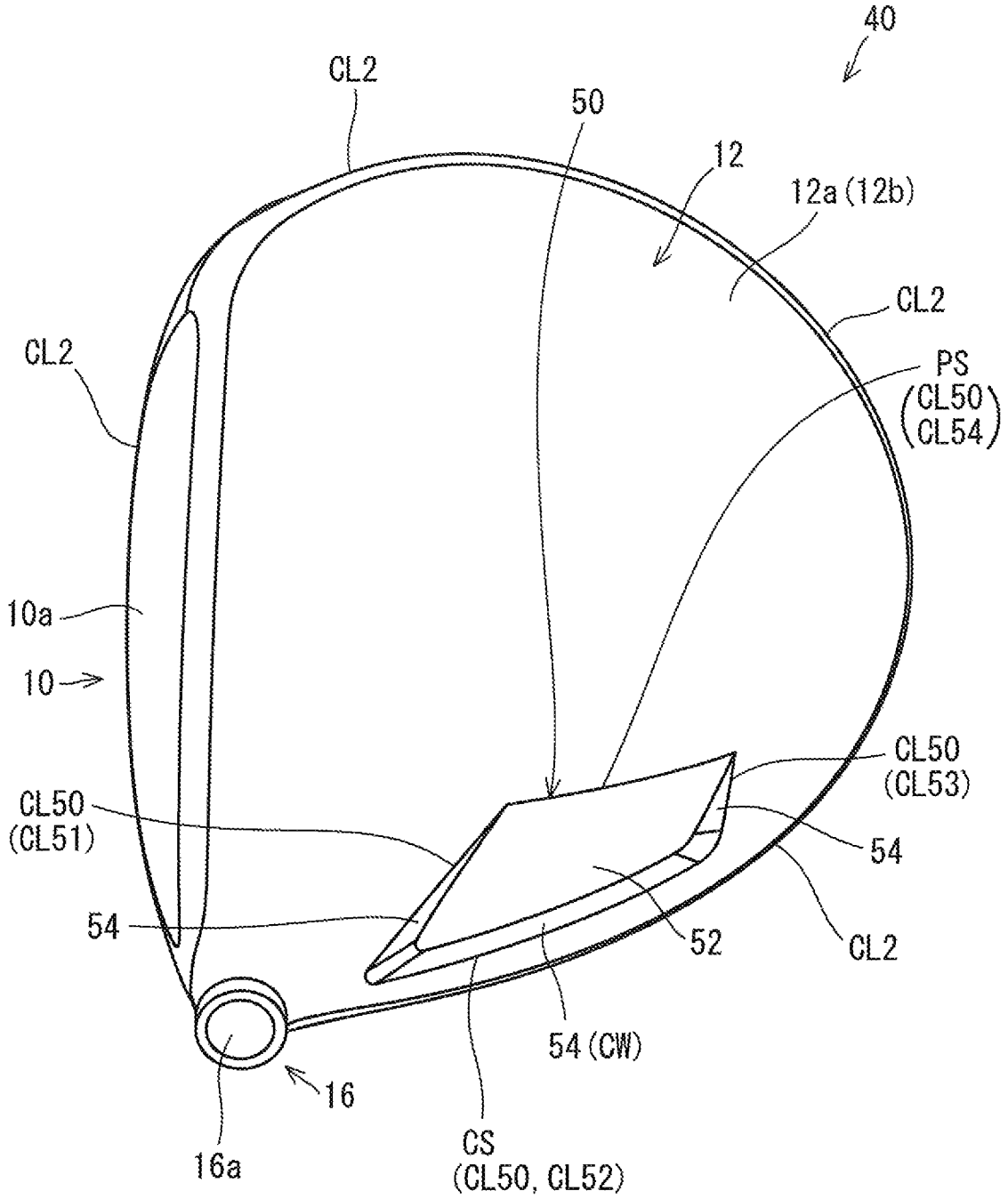
FIG. 14 is a plan view of a head according to a second embodiment as viewed from the crown side.

FIG. 14 is a plan view of a head 40 according to a second embodiment. The difference between the head 40 and the above-described head 4 is only the shape of the protruding portion.

The head 40 includes a face portion 10, a crown portion 12, a sole portion 14, and a hosel portion 16. The face portion 10 includes a striking face 10*a*. The striking face 10*a* is the outer surface of the face portion 10. The crown portion 12 forms a crown outer surface 12*a*. The sole portion 14 forms a sole outer surface 14*a*. The hosel portion 16 has a shaft hole 16*a*. The striking face 10*a* has a face center Fc as defined above. The crown portion 12 includes a protruding portion 50 on the crown outer surface 12*a*. The protruding portion 50 is hollow. The protruding portion 50 forms a projection on the crown outer surface 12*a* and forms a recess on a crown inner surface.

As with the head 4, in the head 40, the protruding portion 50 is not viewable in the front view of the head as viewed from the face side. The entirety of the protruding portion 50 is provided on the crown outer surface 12*a*. The head 40 has an outer contour line CL2 in the plan view (planar view) of the head 40. The protruding portion 50 does not reach the outer contour line CL2. The protruding portion 50 does not extend to other portions than the crown outer surface 12*a*. The entirety of the protruding portion 50 is positioned on the heel side with respect to the face center.

The crown outer surface 12*a* includes a crown base surface 12*b*. Of the crown outer surface 12*a*, a portion in which the protruding portion 50 is not present is formed by the crown base surface 12*b*. The crown base surface 12*b* is a convex curved surface that is smooth and continuous. The convex curved surface is a curved surface that is convex toward the outside of the head 40.

The protruding portion 50 includes a contour line CL50, an upper surface 52, and a sidewall surface 54. The contour line CL50 is a boundary line between the crown base surface 12*b* and the protruding portion 50. In the plan view of the head 40, the protruding portion 50 has a substantially quadrilateral shape (substantially trapezoidal shape). The contour line CL50 forms the substantially quadrilateral shape. The contour line CL50 has a first side CL51, a second side CL52, a third side CL53, and a fourth side CL54.

The first side CL51 constitutes a side on the face side of the protruding portion 50. The first side CL51 extends toward the back side as it goes to the toe side. The first side CL51 connects the second side CL52 and the fourth side CL54.

The second side CL52 constitutes a side on the heel side of the protruding portion 50. The second side CL52 extends toward the back side as it goes to the toe side. The second side CL52 connects the first side CL51 and the third side CL53. The second side CL52 constitutes a curved line that projects toward the outside of the head 40.

The third side CL53 constitutes a side on the back side of the protruding portion 50. The third side CL53 extends toward the back side as it goes to the toe side. The third side CL53 connects the second side CL52 and the fourth side CL54.

The fourth side CL54 constitutes a side on the toe side of the protruding portion 50. The fourth side CL54 extends toward the back side as it goes to the toe side. The fourth side CL54 connects the third side CL53 and the first side CL51.

The first side CL51, the second side CL52, and the third side CL53 constitute a starting line of the sidewall surface 54. That is, the first side CL51, the second side CL52, and the third side CL53 constitute the boundary line between the sidewall surface 54 and the crown base surface 12*b*. On the other hand, the fourth side CL54 does not constitute a starting line of the sidewall surface 54. The fourth side CL54 constitutes the boundary line between the crown base surface 12*b* and the upper surface 52.

Figure 15:
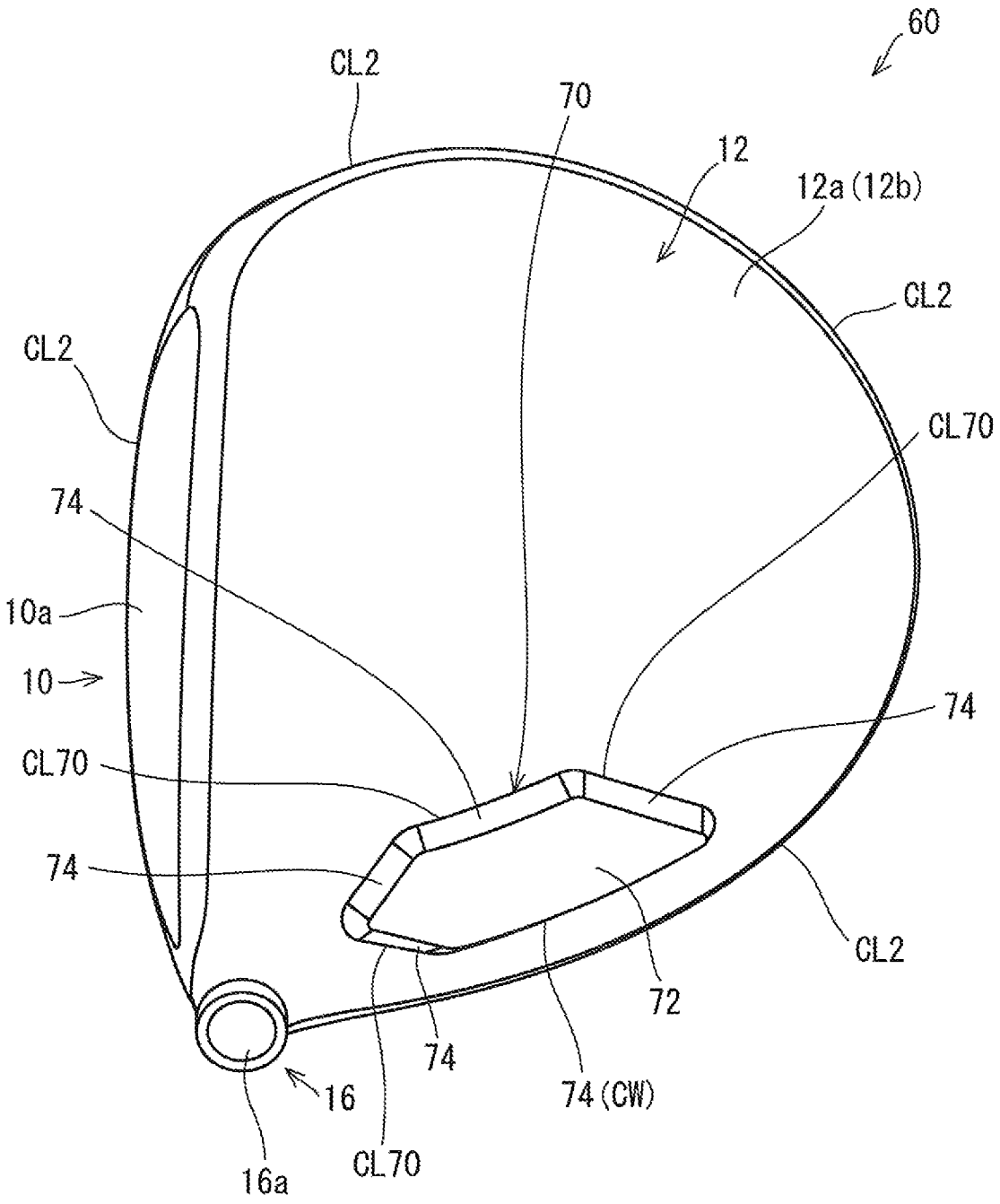
FIG. 15 is a plan view of a head according to a third embodiment as viewed from the crown side.

FIG. 15 is a plan view of a head 60 according to a third embodiment. The difference between the head 60 and the above-described head 4 is only the shape of the protruding portion.

The head 60 includes a face portion 10, a crown portion 12, a sole portion 14, and a hosel portion 16. The face portion 10 includes a striking face 10*a*. The striking face 10*a* is the outer surface of the face portion 10. The crown portion 12 forms a crown outer surface 12*a*. The sole portion 14 forms a sole outer surface 14*a*. The hosel portion 16 has a shaft hole 16*a*. The striking face 10*a* has a face center Fc as defined above. The crown portion 12 includes a protruding portion 70 on the crown outer surface 12*a*. The protruding portion 70 is hollow. The protruding portion 70 forms a projection on the crown outer surface 12*a* and forms a recess on a crown inner surface.

As with the head 4, in the head 60, the protruding portion 70 is not viewable in the front view of the head as viewed from the face side. The entirety of the protruding portion 70 is provided on the crown outer surface 12*a*. The head 60 has an outer contour line CL2 in the plan view (planar view) of the head 60. The protruding portion 70 does not reach the outer contour line CL2. The entirety of the protruding portion 70 is located on the heel side with respect to the face center.

The crown outer surface 12*a* includes a crown base surface 12*b*. Of the crown outer surface 12*a*, a portion in which the protruding portion 70 is not present is formed by the crown base surface 12*b*. The crown base surface 12*b* is a convex curved surface that is smooth and continuous.

The protruding portion 70 includes a contour line CL70, an upper surface 72, and a sidewall surface 74. The contour line CL70 is a boundary line between the crown base surface 12*b* and the protruding portion 70. In the plan view (planar view) of the head 60, the protruding portion 70 has a substantially pentagonal shape. The contour line CL70 forms the substantially pentagonal shape. The sidewall surface 74 is formed along all sides constituting this substantially pentagonal shape. Although not visually recognized from the viewing angle in FIG. 15, the sidewall surface 74 is formed also along a side closest to the outer contour line CL2.

Figure 16:
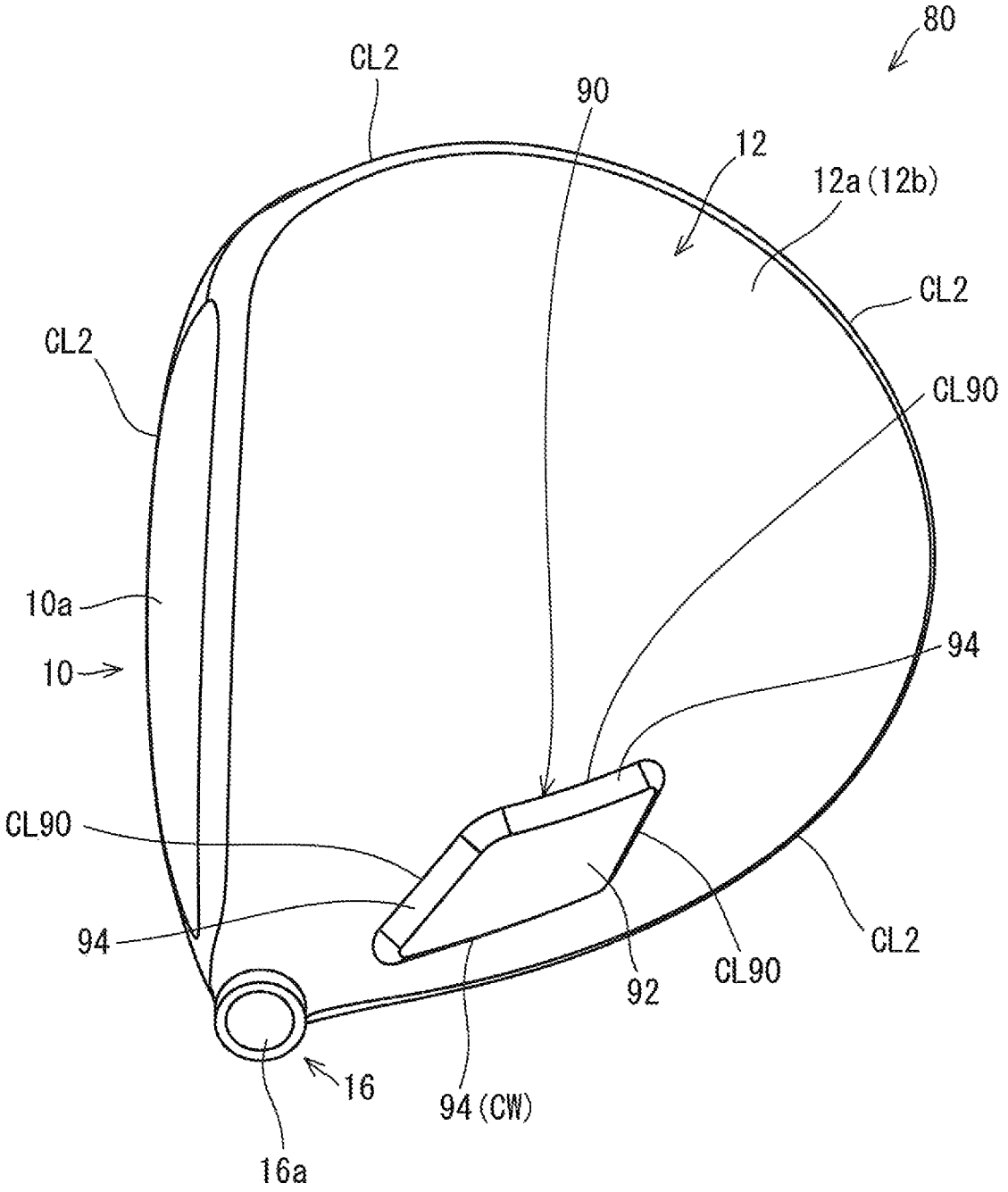
FIG. 16 is a plan view of a head according to a fourth embodiment as viewed from the crown side.

FIG. 16 is a plan view of a head 80 according to a fourth embodiment. The difference between the head 80 and the above-described head 4 is only the shape of the protruding portion.

The head 80 includes a face portion 10, a crown portion 12, a sole portion 14, and a hosel portion 16. The face portion 10 includes a striking face 10*a*. The striking face 10*a* is the outer surface of the face portion 10. The crown portion 12 forms a crown outer surface 12*a*. The sole portion 14 forms a sole outer surface 14*a*. The hosel portion 16 has a shaft hole 16*a*. The striking face 10*a* has a face center Fc as defined above. The crown portion 12 includes a protruding portion 90 on the crown outer surface 12*a*. The protruding portion 90 is hollow. The protruding portion 90 forms a projection on the crown outer surface 12*a* and forms a recess on a crown inner surface.

As with the head 4, in the head 80, the protruding portion 90 is not viewable in the front view of the head as viewed from the face side. The entirety of the protruding portion 90 is provided on the crown outer surface 12*a*. The head 80 has an outer contour line CL2 in the plan view (planar view) of the head 80. The protruding portion 90 does not reach the outer contour line CL2. The entirety of the protruding portion 90 is positioned on the heel side with respect to the face center.

The crown outer surface 12*a* includes a crown base surface 12*b*. Of the crown outer surface 12*a*, a portion in which the protruding portion 90 is not present is formed by the crown base surface 12*b*. The crown base surface 12*b* is a convex curved surface that is smooth and continuous.

The protruding portion 90 includes a contour line CL90, an upper surface 92, and a sidewall surface 94. The contour line CL90 is a boundary line between the crown base surface 12*b* and the protruding portion 90. In the plan view of the head 80, the protruding portion 90 has a substantially quadrilateral shape. The contour line CL90 forms the substantially quadrilateral shape. The sidewall surface 94 is formed along all sides constituting this substantially quadrilateral shape. Although not visually recognized from the viewing angle in FIG. 16, the sidewall surface 94 is formed also along a side closest to the outer contour line CL2.

Figure 17:
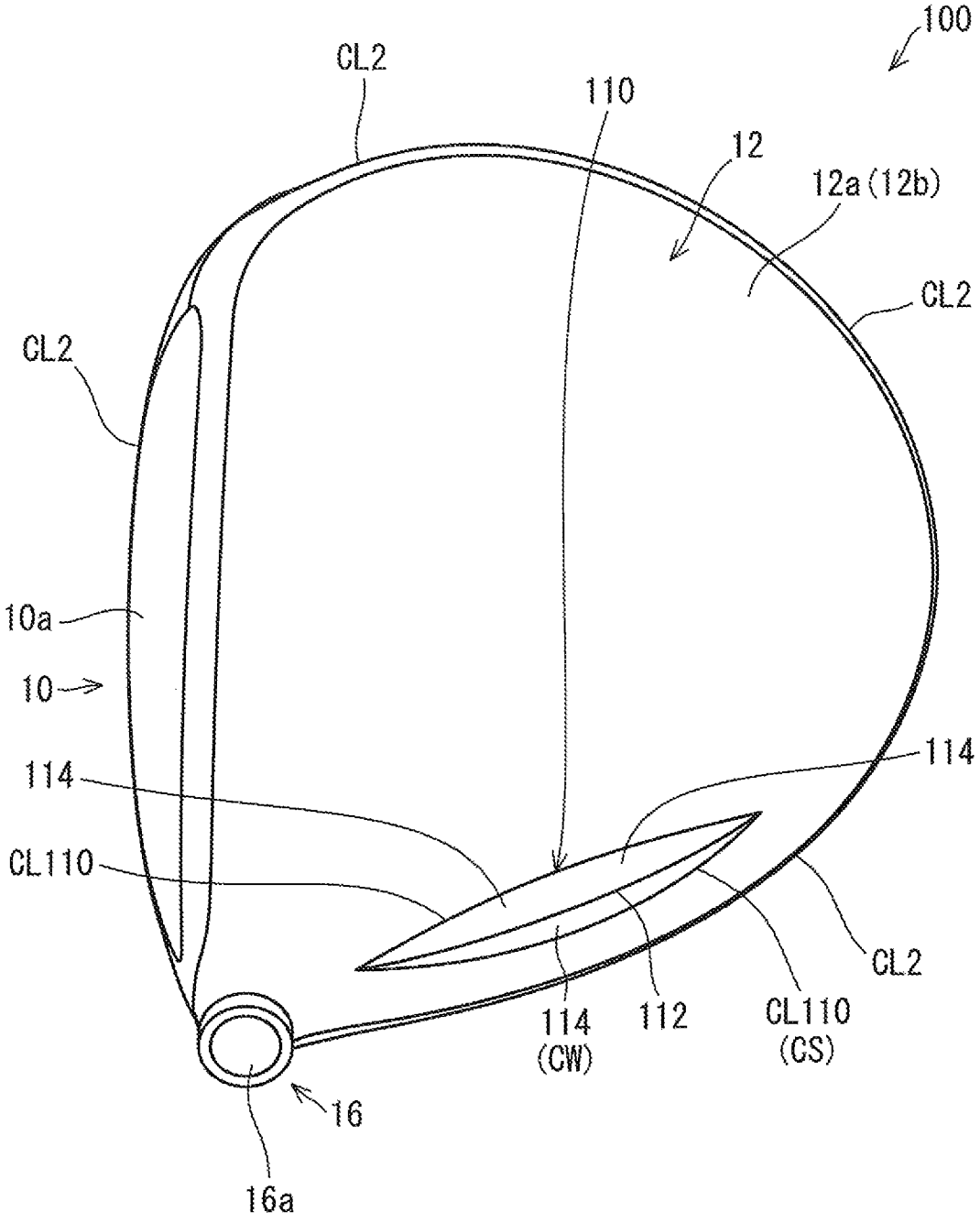
FIG. 17 is a plan view of a head according to a fifth embodiment as viewed from the crown side.

FIG. 17 is a plan view (planar view) of a head 100 according to a fifth embodiment. The difference between the head 100 and the above-described head 4 is only the shape of the protruding portion.

The head 100 includes a face portion 10, a crown portion 12, a sole portion 14, and a hosel portion 16. The face portion 10 includes a striking face 10*a*. The striking face 10*a* is the outer surface of the face portion 10. The crown portion 12 forms a crown outer surface 12*a*. The sole portion 14 forms a sole outer surface 14*a*. The hosel portion 16 has a shaft hole 16*a*. The striking face 10*a* has a face center Fc as defined above. The crown portion 12 includes a protruding portion 110 on the crown outer surface 12*a*. The protruding portion 110 is hollow. The protruding portion 110 forms a projection on the crown outer surface 12*a* and forms a recess on a crown inner surface.

As with the head 4, in the head 100, the protruding portion 110 is not viewable in the front view of the head as viewed from the face side. The entirety of the protruding portion 110 is provided on the crown outer surface 12*a*. The head 100 has an outer contour line CL2 in the plan view (planar view) of the head 100. The protruding portion 110 does not reach the outer contour line CL2. The entirety of the protruding portion 110 is positioned on the heel side with respect to the face center.

The crown outer surface 12*a* includes a crown base surface 12*b*. Of the crown outer surface 12*a*, a portion in which the protruding portion 110 is not present is formed by the crown base surface 12*b*. The crown base surface 12*b* is a convex curved surface that is smooth and continuous.

The protruding portion 110 includes a contour line CL110, a ridgeline 112 formed by vertices, and sidewall surfaces 114. The ridgeline 112 is formed by the sidewall surfaces 114 intersecting with each other. The protruding portion 110 does not have an upper surface. The contour line CL110 is a boundary line between the crown base surface 12*b* and the protruding portion 110. The protruding portion 110 is constituted by one ridgeline 112 and two sidewall surfaces 114. The protruding portion 110 forms a projection having a ridgeline.

Figure 18:
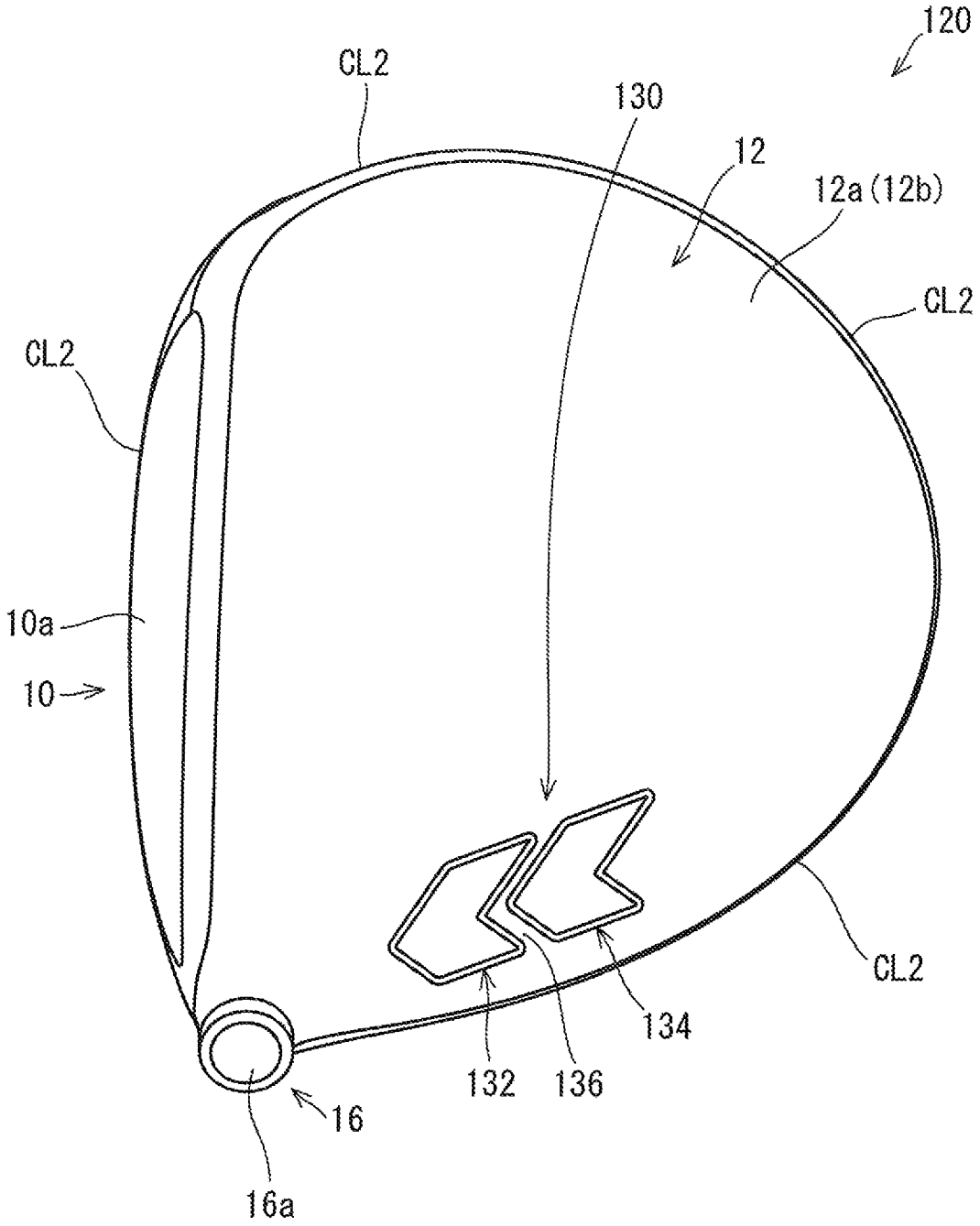
FIG. 18 is a plan view of a head according to a sixth embodiment as viewed from the crown side.

FIG. 18 is a plan view of a head 120 according to a sixth embodiment. The difference between the head 120 and the above-described head 4 is only the shape of the protruding portion.

The head 120 includes a face portion 10, a crown portion 12, a sole portion 14, and a hosel portion 16. The face portion 10 includes a striking face 10*a*. The striking face 10*a* is the outer surface of the face portion 10. The crown portion 12 forms a crown outer surface 12*a*. The sole portion 14 forms a sole outer surface 14*a*. The hosel portion 16 has a shaft hole 16*a*. The striking face 10*a* has a face center Fc as defined above. The crown portion 12 includes a protruding portion 130 on the crown outer surface 12*a*. The protruding portion 130 is hollow. The protruding portion 130 forms projections on the crown outer surface 12*a* and forms recesses on a crown inner surface.

As with the head 4, in the head 120, the protruding portion 130 is not viewable in the front view of the head as viewed from the face side. The entirety of the protruding portion 130 is provided on the crown outer surface 12*a*. The head 120 has an outer contour line CL2 in the plan view (planar view) of the head 120. The protruding portion 130 does not reach the outer contour line CL2. The entirety of the protruding portion 130 is positioned on the heel side with respect to the face center.

The crown outer surface 12*a* includes a crown base surface 12*b*. Of the crown outer surface 12*a*, a portion in which the protruding portion 130 is not present is formed by the crown base surface 12*b*. The crown base surface 12*b* is a convex curved surface that is smooth and continuous.

The protruding portion 130 is divided into a plurality of (two) parts. The protruding portion 130 has a first part 132 and a second part 134. The first part 132 and the second part 134 are positioned apart from each other. A parting groove 136 is formed between the first part 132 and the second part 134. This parting groove 136 extends in a bending manner.

Figure 19A:
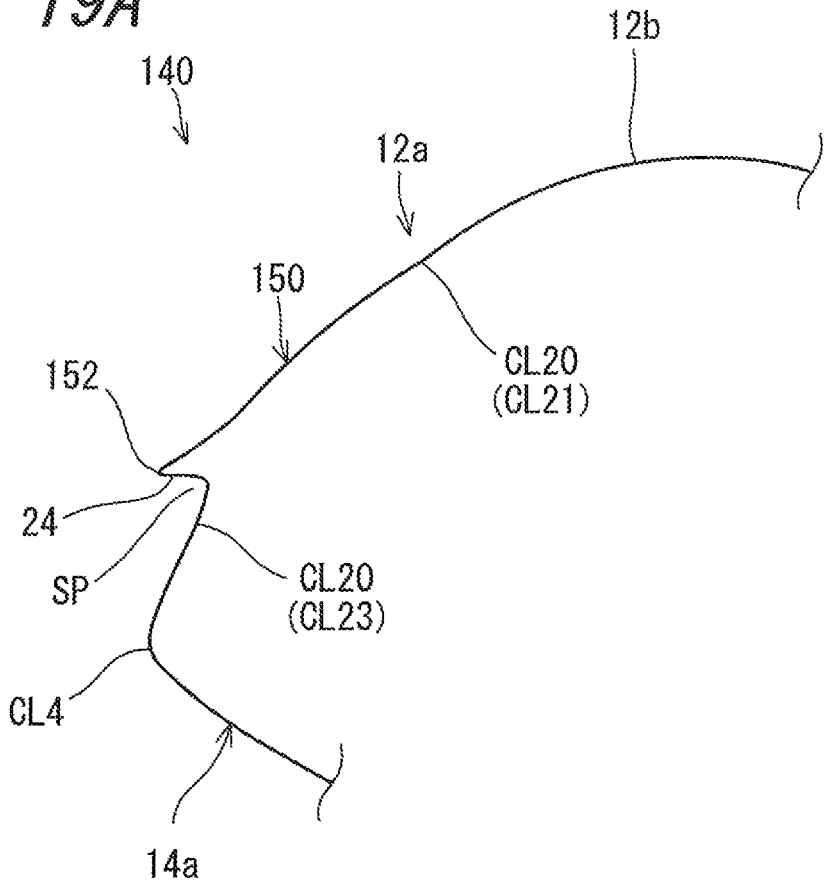
FIG. 19A shows a part of an outer contour line of a head according to a seventh embodiment as viewed from the toe-back side.

FIG. 19A shows a part of an outer contour line of a head 140 according to a seventh embodiment as viewed from the toe-back side. The head 140 includes a protruding portion 150. The protruding portion 150 is the same as the protruding portion 20 of the first embodiment except that a part of the sidewall surface 24 formed along the third side CL23 of the contour line CL20 is recessed. In the head 140, a space SP is formed between a highest portion 152 of the protruding portion 150 and the crown outer surface 12*a*. The highest portion 152 is a portion whose height H1 is the maximum. The definition of the height H1 is as described above. From the viewpoint of increasing aerodynamic drag at a position 9, the space SP is preferably provided on a contour proximate wall surface CW (detailed later).

Figure 19B:
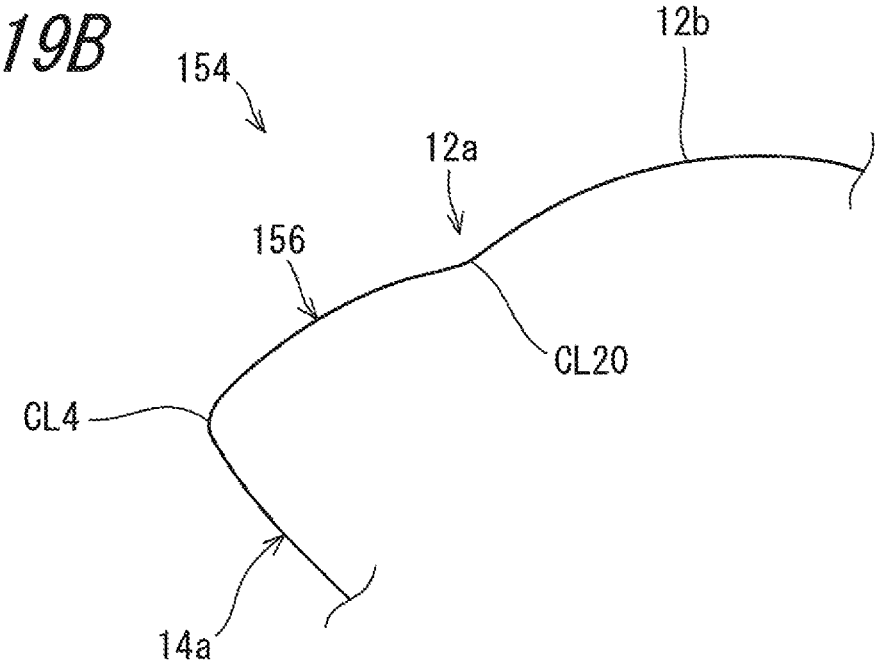
FIG. 19B shows a part of an outer contour line of a head according to an eighth embodiment as viewed from the toe-back side.

FIG. 19B shows a part of an outer contour line of a head 154 according to an eighth embodiment as viewed from the toe-back side. The head 154 includes a protruding portion 156. The protruding portion 156 reaches the outer peripheral edge (outer contour line CL4) of the crown portion. In a planar view of the head 154, a part of the contour line of the protruding portion 156 coincides with the outer contour line CL4 of the crown portion.

Figure 21A:
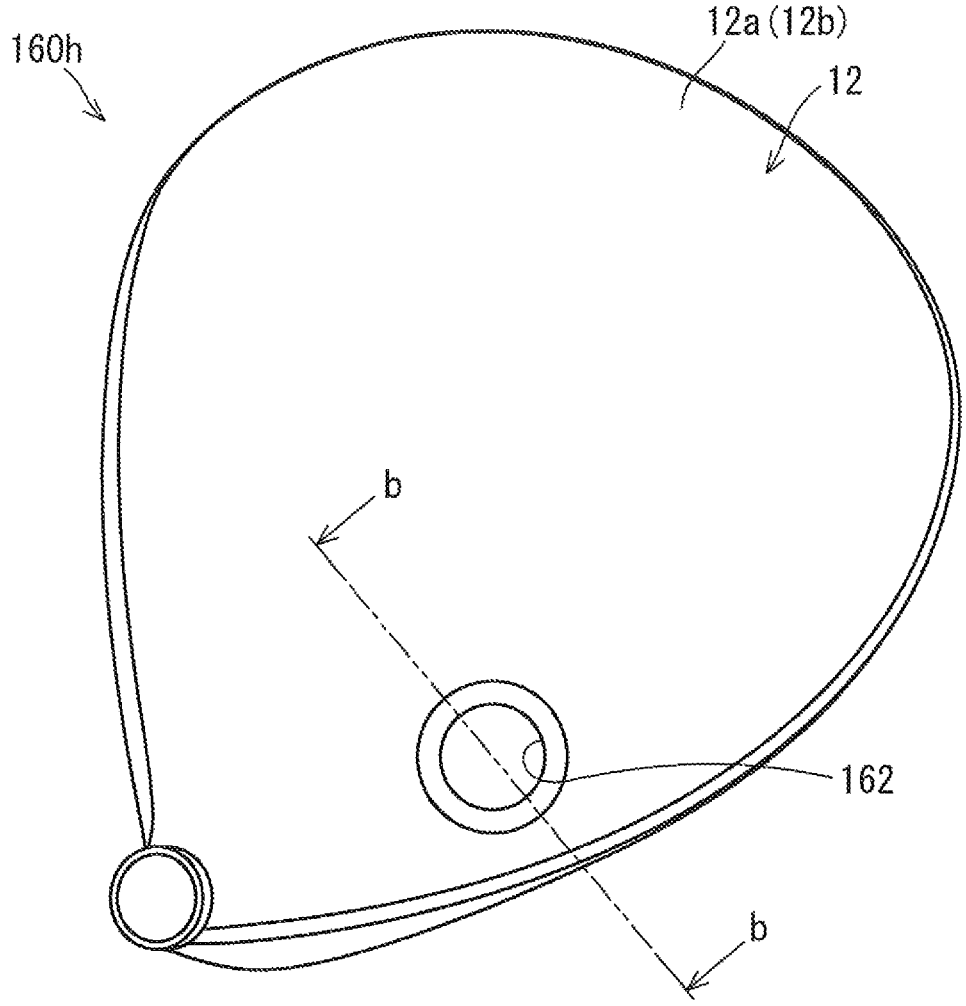
FIG. 21A is a perspective view of the head body of the head of the ninth embodiment.
Figure 21B:
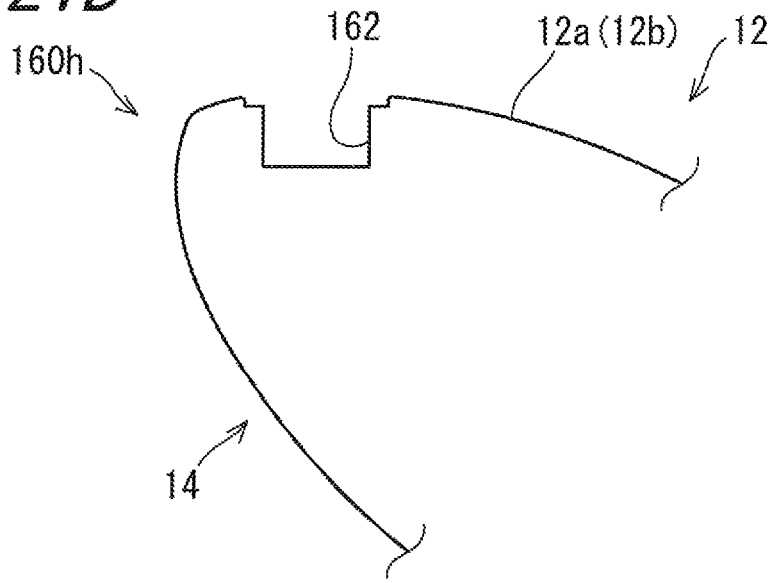
FIG. 21B is a cross-sectional view taken along line b-b in FIG. 21A, however, the depiction of the cross section of the head body is omitted in FIG. 21B.

FIG. 20A is a perspective view of a head 160 according to a ninth embodiment. FIG. 20B is a cross-sectional view taken along line b-b in FIG. 20A. FIG. 21A is a perspective view of a head body 160*h* of the head 160. FIG. 21B is a cross-sectional view taken along line b-b in FIG. 21A. With regard to the head body in FIG. 20B and FIG. 21B, the depiction of its cross section is omitted, and only the cross-sectional contour line of its outer surface is shown.

The head 160 includes a head body 160*h*, a protruding portion 170, and a fixing jig 172. The protruding portion 170 is attachable to and detachable from the head body 160*h*. The protruding portion 170 is formed by a protruding member 174 that is a member different from the head body. The protruding member 174 is detachably fixed to the head body 160*h* with the fixing jig 172.

The head body 160*h* includes a face portion 10, a crown portion 12, a sole portion 14, and a hosel portion 16. The face portion 10 includes a striking face 10*a*. The striking face 10*a* is the outer surface of the face portion 10. The crown portion 12 forms a crown outer surface 12*a*. The sole portion 14 forms a sole outer surface 14*a*. The hosel portion 16 has a shaft hole 16*a*. The striking face 10*a* has a face center Fc as defined above. The crown portion 12 includes the protruding portion 170 on the crown outer surface 12*a*. The protruding portion 170 is formed by the protruding member 174. The protruding member 174 is detachably fixed to the crown outer surface 12*a*.

As with the head 4, in the head 160, the protruding portion 170 is not viewable in the front view of the head as viewed from the face side. The entirety of the protruding portion 170 is provided on the crown outer surface 12*a*. The head 160 has an outer contour line CL2 in a plan view (planar view) of the head 160.

The crown outer surface 12*a* includes a crown base surface 12*b*. Of the crown outer surface 12*a*, a portion in which the protruding portion 170 is not present is formed by the crown base surface 12*b*. The crown base surface 12*b* is a convex curved surface that is smooth and continuous.

The head body 160*h* includes a port 162. In the present embodiment, the port 162 constitutes a screw hole that forms a female screw. In the present embodiment, the fixing jig 172 is a male screw. The fixing jig 172 can be screw-connected to the port 162. In FIG. 20B, the depiction of screw threads in the screw portions of the port 162 and the fixing jig 172 is omitted.

The protruding member 174 includes a base portion 174*a* and a standing wall portion 174*b* that extends upward from the base portion 174*a*. The standing wall portion 174*b* is formed at an edge of the base portion 174*a*. In the planar view, the protruding member 174 has a substantially polygonal shape (substantially quadrilateral shape). In the planar view, the protruding member 174 has a plurality of (four) sides. The standing wall portion 174*b* is formed on one side of the plurality of (four) sides. The base portion 174*a* has a through hole 174*c* through which the fixing jig 172 is inserted.

As described above, in the present embodiment, the protruding member 174 is fixed by screwing with the fixing jig 172. The structure (means) for fixing the protruding member 174 is not limited to screwing.

This structure having the standing wall portion 174*b* can increase the additional area S2 while suppressing air resistance at the position 6. The standing wall portion 174*b* is formed only on a contour proximate side CS (detailed later). The standing wall portion 174*b* constitutes the contour proximate wall surface CW (detailed later). The standing wall portion 174*b* effectively increases the additional area S2.

Figure 22A:
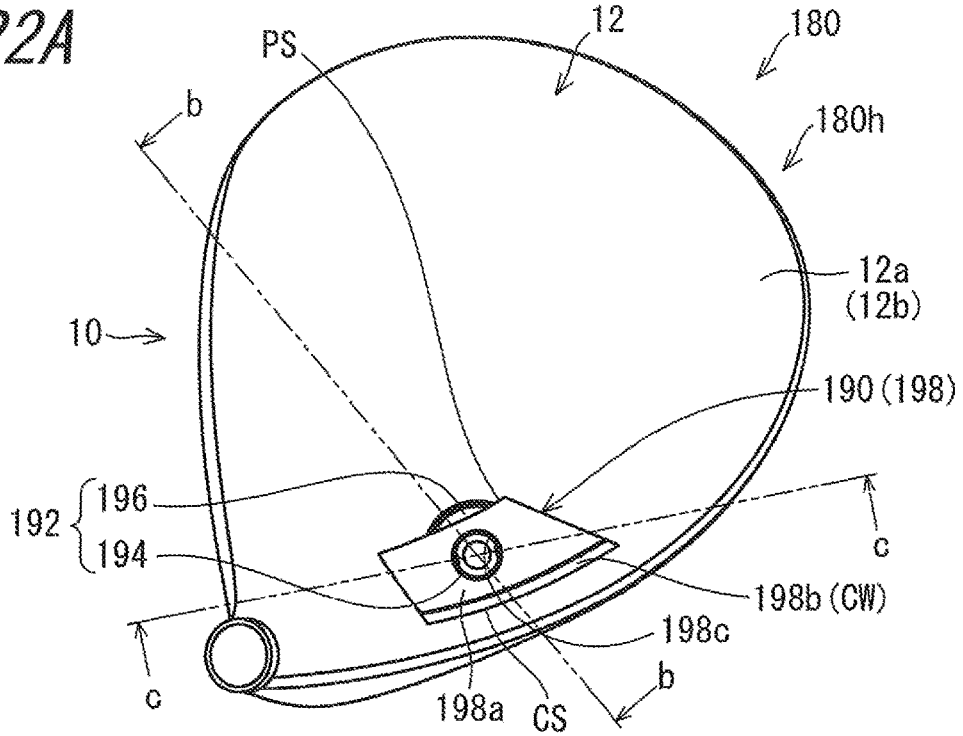
FIG. 22A is a perspective view of a head according to a tenth embodiment.
Figure 22B:
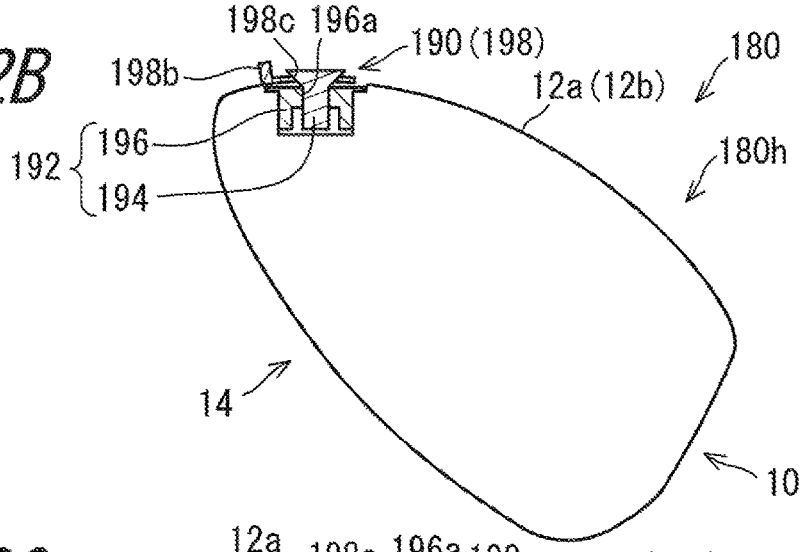
FIG. 22B is a cross-sectional view taken along line b-b in FIG. 22A.
Figure 22C:
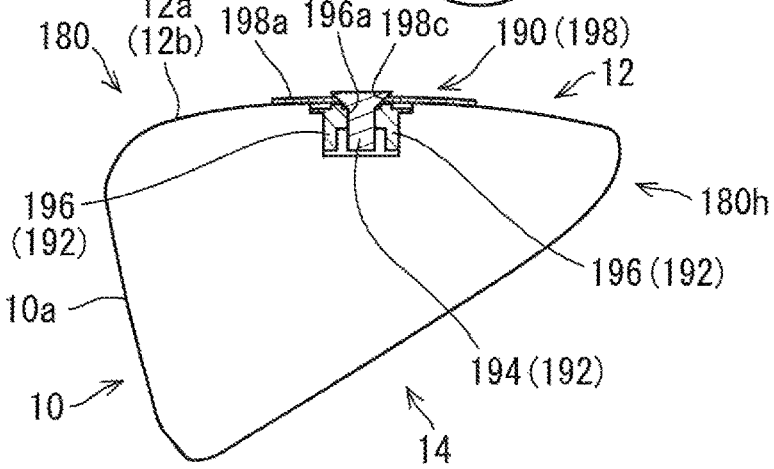
FIG. 22C is a cross-sectional view taken along line c-c in FIG. 22A, however, the depiction of the cross section of a head body is omitted in FIG. 22B and FIG. 22C.
Figure 23A:
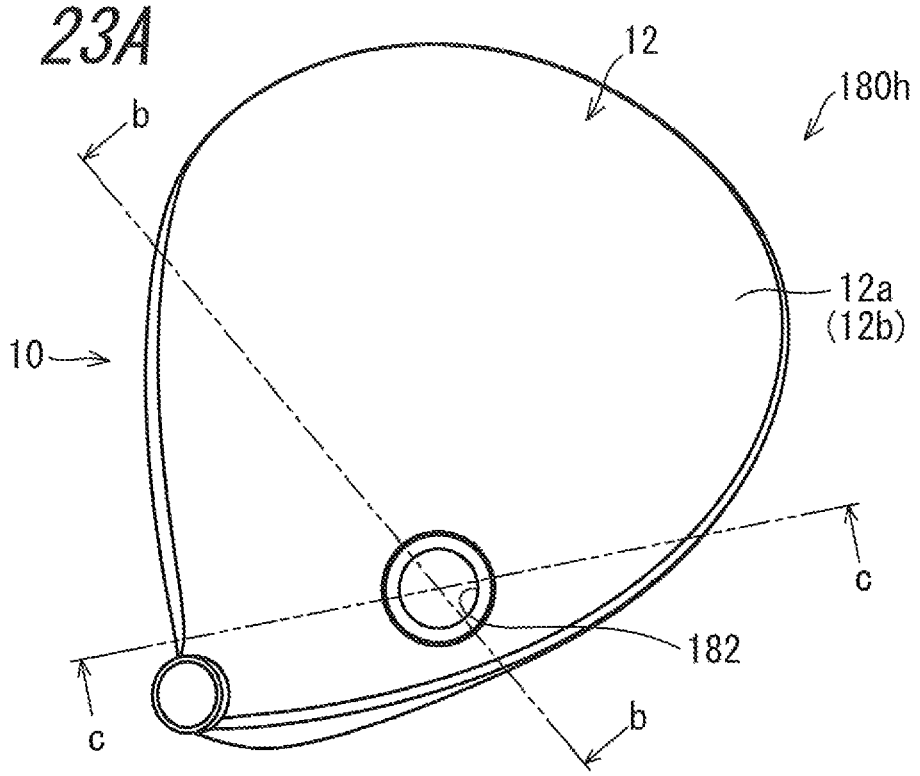
FIG. 23A is a perspective view of the head body of the head of the tenth embodiment.
Figure 23B:
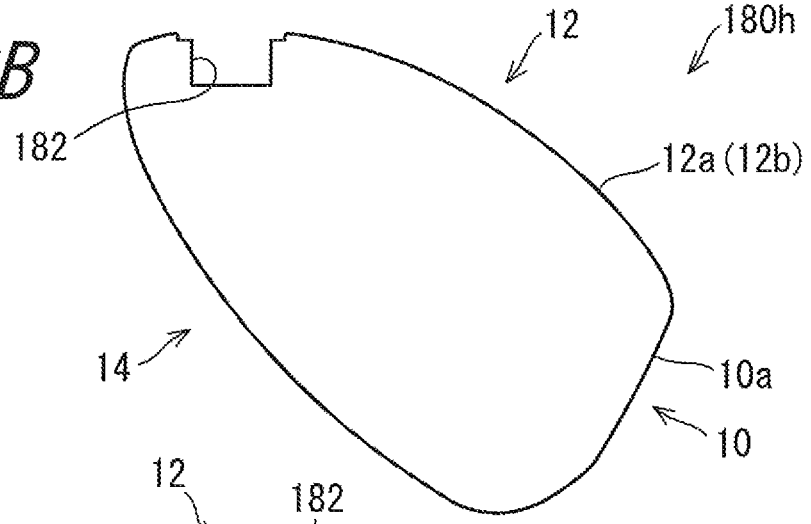
FIG. 23B is a cross-sectional view taken along line b-b in FIG. 23A.
Figure 23C:
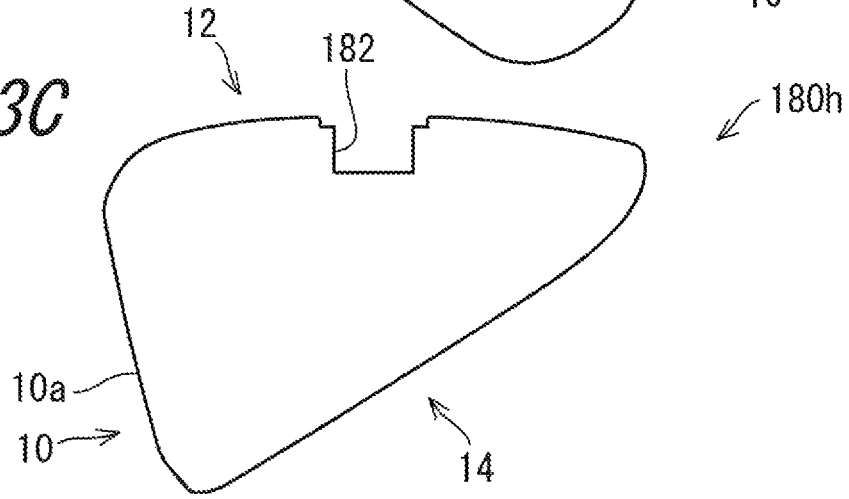
FIG. 23C is a cross-sectional view taken along line c-c in FIG. 23A, however, the depiction of the cross section of the head body is omitted in FIG. 23B and FIG. 23C.

FIG. 22A is a perspective view of a head 180 according to a tenth embodiment. FIG. 22B is a cross-sectional view taken along line b-b in FIG. 22A. FIG. 22C is a cross-sectional view taken along line c-c in FIG. 22A. FIG. 23A is a perspective view of a head body 180*h* of the head 180. FIG. 23B is a cross-sectional view taken along line b-b in FIG. 23A. FIG. 23C is a cross-sectional view taken along line c-c in FIG. 23A. With regard to the head body in FIG. 22B, FIG. 22C, FIG. 23B, and FIG. 23C, the depiction of its cross section is omitted, and only the cross-sectional contour line of its outer surface is shown.

The head 180 includes the head body 180*h*, a protruding portion 190, and a fixing jig 192. The fixing jig 192 includes a screw member 194 and a screw hole member 196. The protruding portion 190 is attachable to and detachable from the head body 180*h*. The protruding portion 190 is formed by a protruding member 198 that is a member different from the head body 180*h*. The protruding member 198 is detachably fixed to the head body 180*h* with the fixing jig 192.

The head body 180*h* includes a face portion 10, a crown portion 12, a sole portion 14, and a hosel portion 16. The face portion 10 includes a striking face 10*a*. The striking face 10*a* is the outer surface of the face portion 10. The crown portion 12 forms a crown outer surface 12*a*. The sole portion 14 forms a sole outer surface 14*a*. The hosel portion 16 has a shaft hole 16*a*. The crown portion 12 includes the protruding portion 190 on the crown outer surface 12*a*. The protruding portion 190 is formed by the protruding member 198. The protruding member 198 is detachably fixed to the crown outer surface 12*a*.

As with the head 4, in the head 180, the protruding portion 190 is not viewable in the front view of the head as viewed from the face side. The entirety of the protruding portion 190 is provided on the crown outer surface 12*a*.

The crown outer surface 12*a* includes a crown base surface 12*b*. Of the crown outer surface 12*a*, a portion in which the protruding portion 190 is not present is formed by the crown base surface 12*b*. The crown base surface 12*b* is a convex curved surface that is smooth and continuous.

The head body 180*h* includes a port 182. In the present embodiment, the port 182 is a recess. The screw hole member 196 is fixed to the port 182. This fixing can be effected by, for example, bonding or welding. The screw hole member 196 has a screw hole 196*a*. The screw member 194 is screw-connected to the screw hole 196*a*. Note that, in FIG. 22B, FIG. 22C, FIG. 23B and FIG. 23C, the depiction of screw threads in screw portions of the screw member 194 and the screw hole 196*a* is omitted.

The protruding member 198 includes a base portion 198*a* and a standing wall portion 198*b* that extends upward from the base portion 198*a*. The standing wall portion 198*b* is formed at an edge of the base portion 198*a*. In a planar view, the protruding member 198 has a substantially polygonal shape (substantially quadrilateral shape). In the planar view, the protruding member 198 has a plurality of (four) sides. The standing wall portion 198*b* is formed on one side of the plurality of (four) sides. The base portion 198*a* has a through hole 198*c* through which the screw member 194 is inserted.

As described above, also in the present embodiment, the protruding member 198 is fixed by screwing with the fixing jig 192. In the present embodiment, the screw hole is formed by the screw hole member 196. The present embodiment is different from the ninth embodiment in that there is no need to form a screw hole in the head body 180*h*.

It should be noted that the screw hole member 196 may be detachably attached to the head body 180*h*. For example, the screw hole member 196 may be attached to the head body 180*h* by screw connection. In this case, the screw hole member 196 can be replaced. This replacement allows users to adjust the weight of the screw hole member 196. For example, when the protruding member 198 is attached, the screw hole member 196 can be made relatively light, and, when the protruding member 198 is not attached, the screw hole member 196 can be made relatively heavy. In this case, the difference between a head weight when the protruding member 198 is attached and a head weight when the protruding member 198 is not attached can be reduced. Furthermore, the head weight when the protruding member 198 is attached can be made equal to the head weight when the protruding member 198 is not attached.

Figure 24:
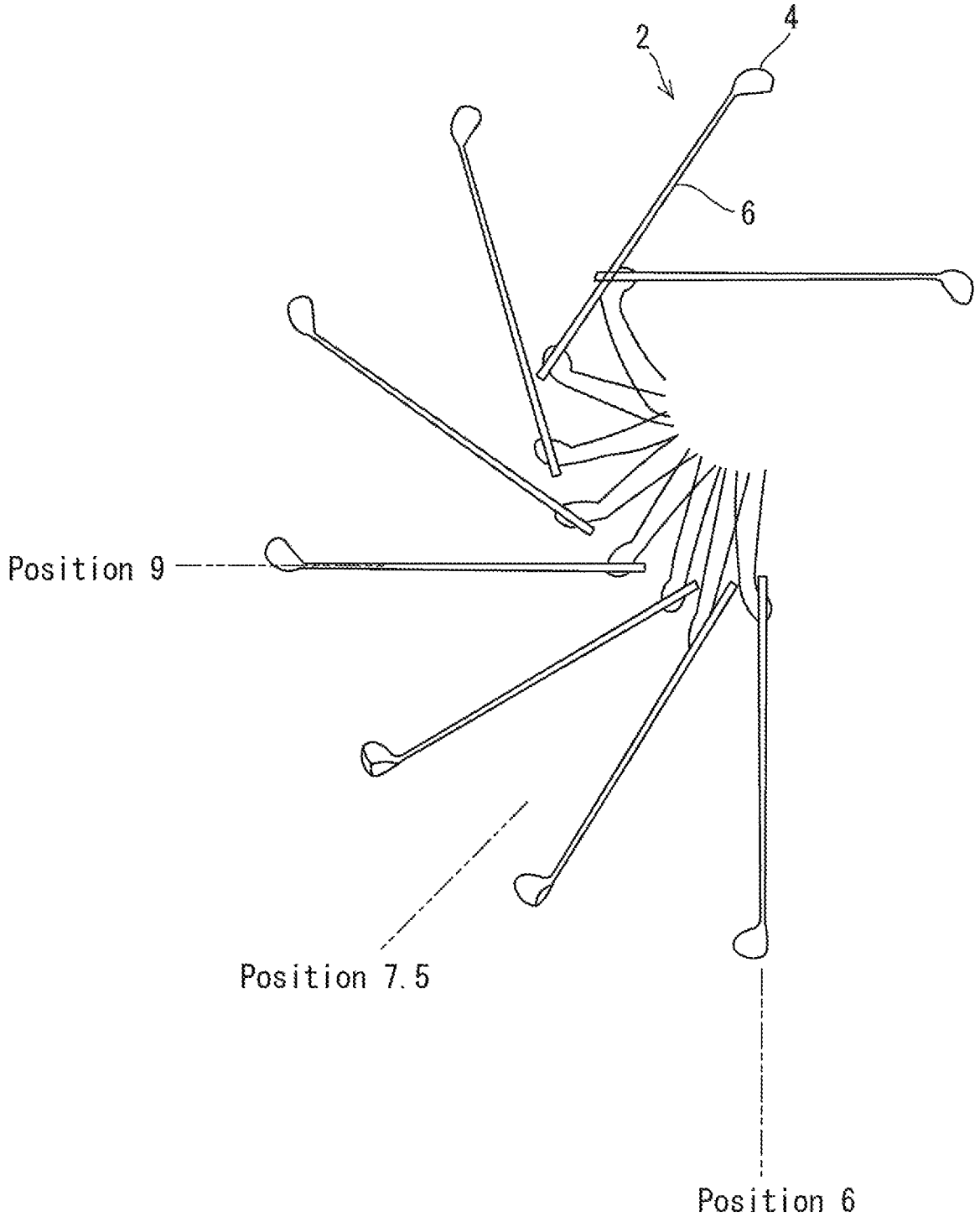
FIG. 24 shows the motion of a golf club during downswing.

FIG. 24 shows the motion of the golf club 2 during downswing. A swinging motion starts from backswing, then transitions from the top of swing to downswing, and reaches impact. With the progress of the downswing, the head speed is accelerated. In addition, with the progress of the downswing, the posture of the head changes.

At a certain point of time during downswing, the shaft 6 of the golf club 2 is made parallel to the ground surface. The position of the golf club 2 at this point of time is also referred to as position 9. A position of the golf club at impact is also referred to as position 6. An intermediate position between the position 9 and the position 6 is also referred to as position 7.5. These positions are named by considering the golf club 2 during swing as an hour hand of a clock. That is, for example, the position 9 coincides with the position of an hour hand at nine o'clock in a clock with hands (analog clock).

Postures of a head during downswing are as follows. Wrists of a golfer turn during downswing (hereinafter, this is also referred to as wrist turn), and the face of the head turns by the time of impact. Accordingly, the head moves with its face-side portion preceding other portions at impact. That is, at impact, the head moves toward the face side in the face-back direction. Until the wrist turn occurs, the head moves with its heel-side portion preceding other portions. It was considered so far that, until the wrist turn occurs, the head moves toward the heel side in the toe-heel direction.

However, the inventors of the present disclosure have found that the traveling direction of a head at the position 9 is actually the heel side in the inclined toe-heel direction, not the heel side in the toe-heel direction. That is, the inventors of the present disclosure have found that, at the position 9, the head moves in a state where its front in the traveling direction is as shown in the heel projection figure (FIG. 5). The centrifugal force acting on the head during a period of time from the top of swing to the position 9 causes the toe down at the position 9. In addition, wrist cock is released at the position 9. When the wrist cock is released, the club rotates about the grip, and the posture of the head changes in the same manner as in the toe down. The inventors of the present disclosure have found that, due to these factors, the traveling direction of the head at the position 9 is actually the inclined toe-heel direction.

The protruding portion 20 is provided on the crown portion 12, and the silhouette area of the heel projection figure is increased, thereby increasing aerodynamic drag (force of air resistance) received by the head 4 at the position 9. This aerodynamic drag cancels a part of the centrifugal force acting on the head center of gravity CG. Accordingly, the increase of the aerodynamic drag reduces the force causing the toe down, and thus the toe down is suppressed.

Furthermore, the protruding portion 20 provided on the crown portion 12 can cause lifting force. At the position 9, air flows in the inclined toe-heel direction. This air provides lifting force to the head 4 in the same manner as the principle of lifting force acting on wings of an airplane. The presence of the protruding portion 20 increases the lifting force at the position 9.

The protruding portion 20 is not viewable in the front view of the head as viewed from the face side. The protruding portion 20 does not form any part of the outer contour line of the head in the front view of the head as viewed from the face side. Accordingly, the protruding portion 20 substantially does not affect aerodynamic drag (force of air resistance) at the position 6. Substantially, the protruding portion 20 does not reduce the head speed.

Figure 25A:
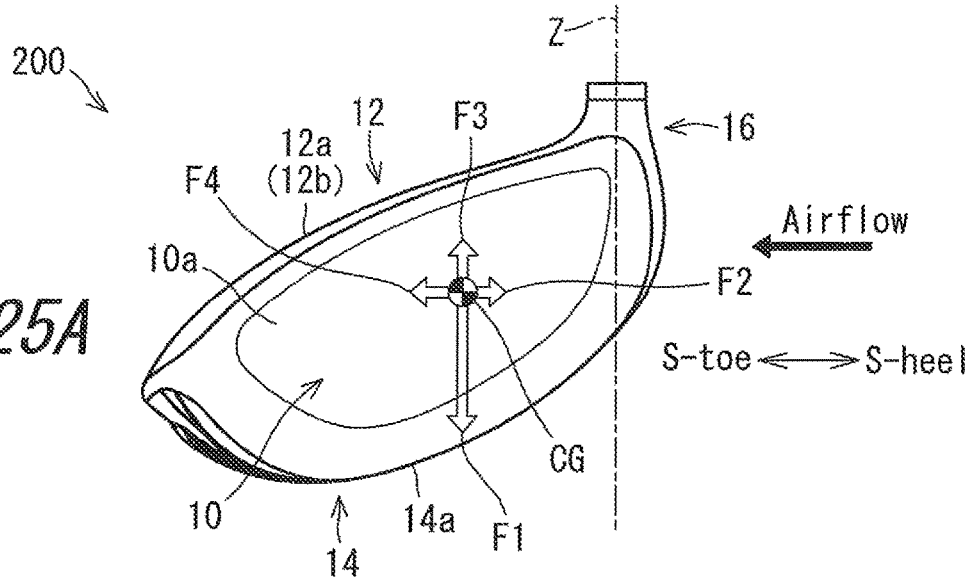
FIG. 25A and FIG. 25B are conceptual diagrams illustrating forces that act on a head having no protruding portion when the head is at a position 9.
Figure 25B:
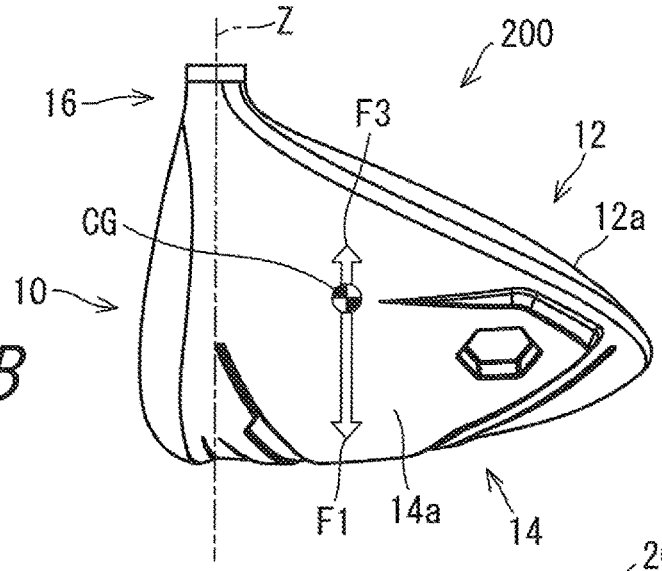
Figure 25C:
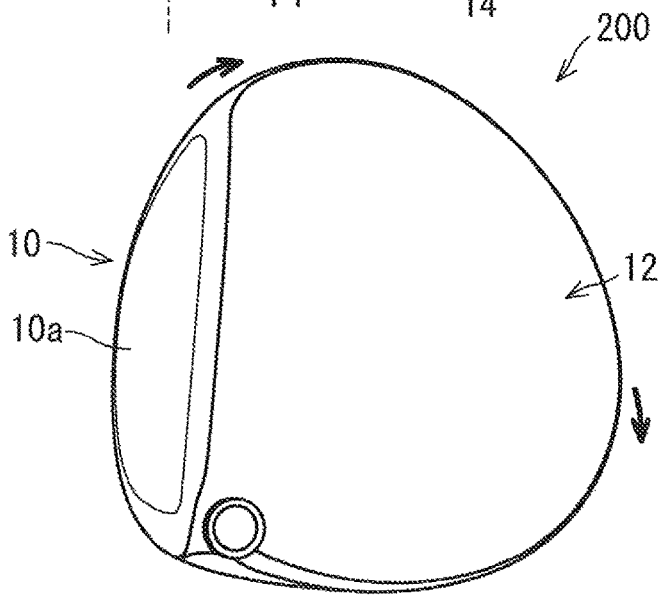
FIG. 25C is a conceptual diagram showing the posture of this head at impact.
Figure 26A:
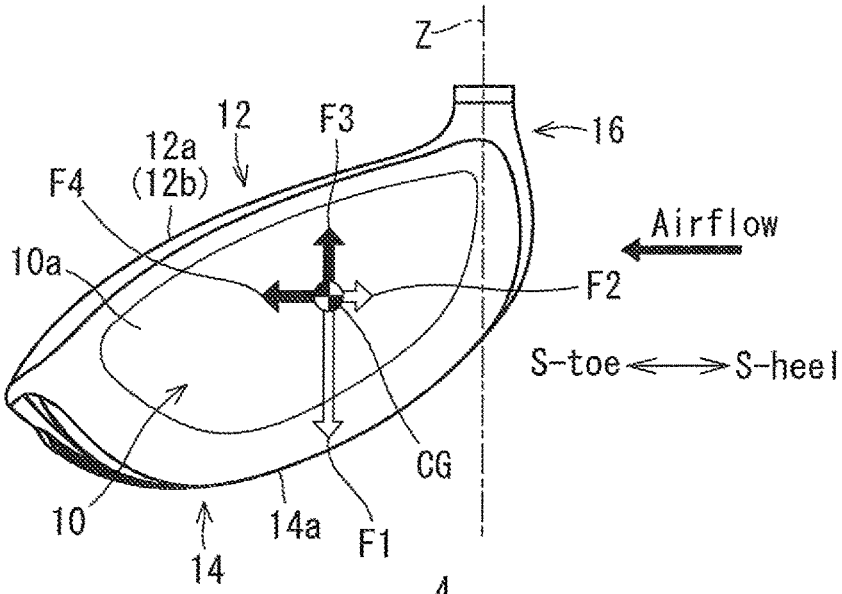
FIG. 26A and FIG. 26B are conceptual diagrams illustrating forces that act on a head having a protruding portion when the head is at the position 9.
Figure 26B:
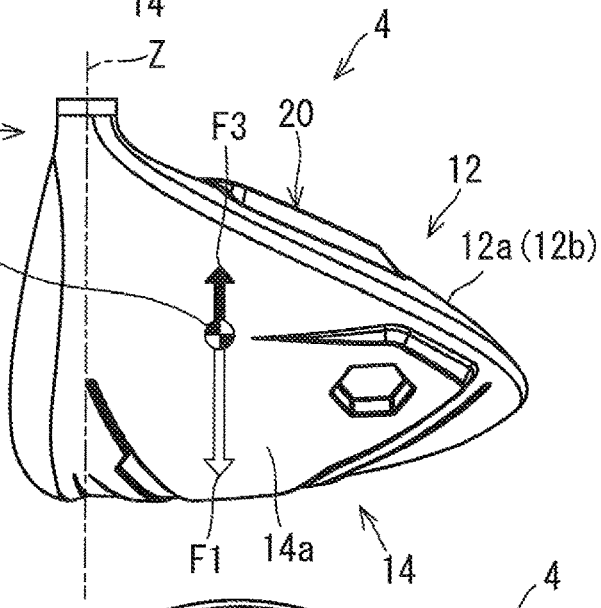
Figure 26C:
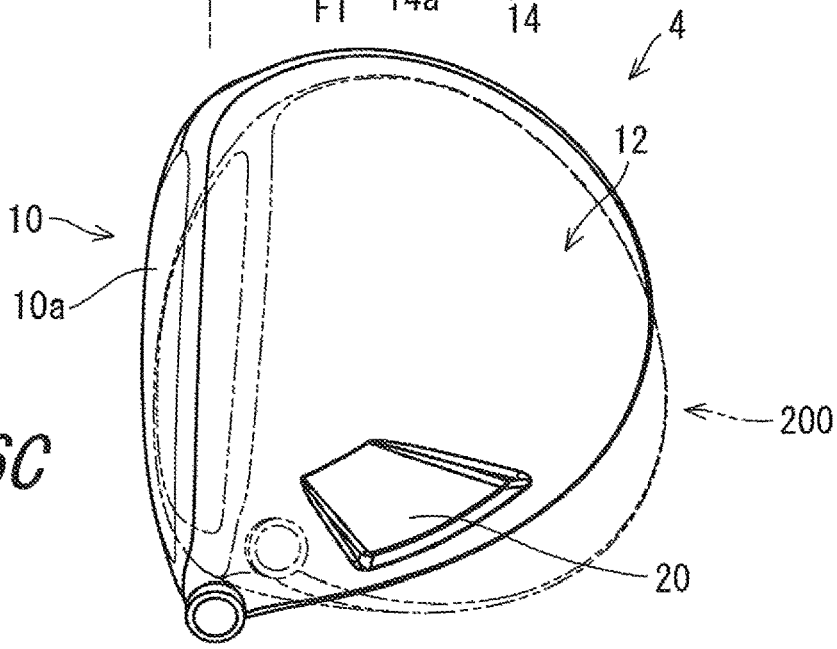
FIG. 26C is a conceptual diagram showing the posture of this head at impact.

FIG. 25A and FIG. 25B are conceptual diagrams illustrating forces acting on a head 200 at the position 9. FIG. 25C shows the head 200 at impact. The head 200 does not include a protruding portion on the crown portion. FIG. 26A and FIG. 26B are conceptual diagrams illustrating forces acting on the head 4 at the position 9. FIG. 26C shows the head 4 at impact. The head 4 is the first embodiment described above.

A centrifugal force acts on the head 200 at the position 9. The centrifugal force acts along a straight line that connects the center of rotation of the golf club 2 and the head center of gravity CG. This centrifugal force is decomposed into a force component F1 parallel to the shaft axis line Z and a force component F2 perpendicular to the shaft axis line Z. On the other hand, an aerodynamic drag (force of air resistance) and a lifting force act on the head 200 at the position 9. The aerodynamic drag and the lifting force act in a direction in which these cancel the centrifugal force. The resultant force obtained from the aerodynamic drag and the lifting force is decomposed into a force component F3 parallel to the shaft axis line Z and a force component F4 perpendicular to the shaft axis line Z. These forces F1 to F4 are schematically shown using arrows. The centrifugal force is greater than the aerodynamic drag and the lifting force, and thus the toe down occurs. As a result, as shown in FIG. 25C, the toe-side portion of the head 200 is lowered, the back-side portion of the head 200 is lowered, and the striking face 10*a* is opened.

By providing the protruding portion 20, the aerodynamic drag and the lifting force acting on the head at the position 9 are increased. The presence of the protruding portion 20 enlarges the additional area S2 in the heel projection figure, and increases the aerodynamic drag. Furthermore, the protruding portion 20 increases the velocity of airflow on the upper side of the head 4 at the position 9, and increases the lifting force. Since the aerodynamic drag and the lifting force increase, the force F3 and the force F4 increase (see the solid black arrows in FIG. 26A and FIG. 26B). As a result, the force of canceling the centrifugal force is increased, and the toe down is suppressed. That is, lowering of the toe-side portion of the head 4 and lowering of the back-side portion of the head 4 are suppressed, and the opening of the striking face 10*a* is suppressed (see FIG. 26C).

Note that, in FIG. 25A, FIG. 25B, FIG. 26A and FIG. 26B, the lengths of the arrows indicating respective forces and the relationship in length between the arrows are not accurate. Similarly, in FIG. 25C and FIG. 26C, the postures of the heads and the relationship of those are not accurate. These drawings are shown for qualitatively understanding the advantageous effects of the present embodiment.

In each of the above-described embodiments except the embodiment of FIG. 17, the protruding portion includes an upper surface, and a sidewall surface that extends from the upper surface to the outer edge of the protruding portion. Because of the presence of the sidewall surface, the height H1 of the protruding portion can be increased, and thus the additional area S2 can be effectively increased.

In the head 4 of the first embodiment, the height H1 of the upper surface 22 decreases toward a head center side. The term "head center" in the head center side can mean the geometric center CR in the plan view of the head 4 (see FIG. 3). In the head which is in the reference state, a plurality of planes that are perpendicular to the ground plane HP, intersect the upper surface 22, and pass through the geometric center CR can be set. In cross sections taken along these planes, the height H1 of the upper surface 22 decreases toward the head center side (geometric center CR side). With this structure, the volume of the protruding portion 20 can be reduced while enlarging the additional area S2. In addition, with regard to the airflow at the position 9, this structure suppresses the disturbance of the airflow, and helps the airflow to run along the crown outer surface 12*a*. This airflow contributes to increase in lifting force.

In the head 4 of the first embodiment, the height H1 of the upper surface 22 decreases toward the face side. That is, the height H1 of the upper surface 22 decreases toward the face side in the cross section taken along the face-back direction (i.e., the crown f-b cross-sectional contour line described above). For this reason, the protruding portion 20 that enlarges the additional area S2 and is unviewable when viewed from the face side can be easily formed. In addition, this structure reduces the influence of the protruding portion 20 on the airflow (airflow in the face-back direction) at impact, and can also reduce the influence on the head speed.

In the head 80 of the fourth embodiment, the height H1 of the upper surface 92 decreases toward the back side. That is, the height H1 of the upper surface 92 decreases toward the back side in the cross section taken along the face-back direction (i.e., the crown f-b cross-sectional contour line described above). Accordingly, regarding the airflow at impact (airflow in the face-back direction), the occurrence of turbulent airflow is suppressed, and the decrease of the head speed is suppressed.

In the head 140 of the seventh embodiment, the space SP is formed between the highest portion 152 of the protruding portion 150 and the crown outer surface 12*a*. This structure having the space SP tends to receive airflow. This structure contributes to increase in aerodynamic drag at the position 9.

In the head 100 of the fifth embodiment, the protruding portion 110 includes the ridgeline 112 formed by vertices, and the sidewall surfaces 114 extending from the ridgeline 112 to the outer edge CL110 of the protruding portion 110. Because of this structure, the volume of the protruding portion 110 can be reduced and the additional area S2 can be enlarged. This protruding portion 110 can reduce the influence of the protruding portion 110 on airflow at impact (position 6) while increasing aerodynamic drag at the position 9.

In the head 160 of the ninth embodiment, the head 160 includes the head body 160*h* forming the crown portion 12, and the protruding member 174 that is detachably fixed to the head body 160*h* and constitutes the protruding portion 170. In this structure, since the protruding portion 170 can be made by a material (a resin, for example) different from that of the head body 160*h*, the weight of the protruding portion 170 can be reduced and/or the degree of freedom in forming of the protruding portion 170 can be increased. In addition, the performance of the head can be changed by attaching or detaching the protruding member 174. The protruding member 174 is detachably fixed to the head body 160*h* with the fixing jig 172. Accordingly, the protruding member 174 can be easily attached and detached. Furthermore, the protruding member 174 may be configured such that it is attached and detached using a dedicated tool, and thus this facilitates conformity to golf rules.

By increasing the height H1, the additional area S2 can be increased. From this viewpoint, the maximum value of the height H1 of the protruding portion is preferably greater than or equal to 1 mm, more preferably greater than or equal to 2 mm, and still more preferably greater than or equal to 3 mm. From the viewpoint of the degree of freedom in designing the position of the head center of gravity, the maximum value of the height H1 of the protruding portion is preferably less than or equal to 20 mm, more preferably less than or equal to 17 mm, and still more preferably less than or equal to 15 mm.

Of the crown outer surface 12*a*, an area of a portion located on the heel side with respect to the face center Fc is defined as Sh ($mm^2$). An area of the protruding portion is defined as St ($mm^2$). The area Sh and the area St are measured in the plan view of the head (FIG. 3, for example). In FIG. 3, the area Sh is the area of a portion located on the heel side with respect to a straight line LC that passes through the face center Fc and extends in the face-back direction. From the viewpoint of increasing the aerodynamic drag and lifting force at the position 9, a ratio of the area St to the area Sh is preferably greater than or equal to 5%, more preferably greater than or equal to 15%, and still more preferably greater than or equal to 20%. From the viewpoint of the degree of freedom in designing the position of the head center of gravity, the ratio of the area St to the area Sh is preferably less than or equal to 70%, more preferably less than or equal to 60%, and still more preferably less than or equal to 50%.

As explained using FIG. 3, the protruding portion 20 has the contour line CL20. A distance D1 between each point on the contour line CL20 and the outer contour line CL2 is defined. As shown in FIG. 7, the distance D1 is defined as a distance (shortest distance) in the t-h cross-sectional contour line.

The sides constituting the contour line CL20 include a side closest to the outer contour line CL2. In the embodiment of FIG. 3, the side closest to the outer contour line CL2 is the third side CL23. This side is defined as a contour proximate side CS that means a side closest to the outer contour line CL2 in the plurality of sides. In the embodiment of FIG. 14, the second side CL52 is the contour proximate side CS. The minimum value of the distance D1 of the contour proximate side CS is smaller than the minimum value of the distance D1 of the other sides. The maximum value of the distance D1 of the contour proximate side CS is smaller than the maximum value of the distance D1 of the other sides. The maximum value of the distance D1 of the contour proximate side CS is smaller than the minimum value of the distance D1 of the other sides.

As shown in FIG. 3, the contour proximate side CS extends substantially along the outer contour line CL2. The outer contour line CL2 includes the outer contour line CL4 of the crown portion 12 in the plan view of the head. The contour proximate side CS extends substantially along the outer contour line CL4.

By providing the contour proximate side CS, the position of the protruding portion 20 is made closer to the outer contour line CL4 on the heel side. For this reason, the additional area S2 in the heel projection figure can be effectively increased. From this viewpoint, the maximum value of the distance D1 in the entirety of the contour proximate side CS is preferably less than or equal to 25 mm, more preferably less than or equal to 20 mm, and still more preferably less than or equal to 15 mm. The maximum value may be 0 mm. When the protruding portion 20 extends to reach the outer contour line CL4 of the crown portion 12, the maximum value of the distance D1 is 0 mm.

The contour proximate side CS preferably extends along the outer contour line CL4. In this case, the additional area S2 can be effectively increased. From this viewpoint, a maximum value D1max and a minimum value D1min of the distance D1 of the contour proximate side CS are taken into consideration. When the contour proximate side CS extends along the outer contour line CL4, a difference (D1max−D1min) is made smaller. From this viewpoint, the difference (D1max−D1min) is preferably less than or equal to 15 mm, more preferably less than or equal to 13 mm, and still more preferably less than or equal to 10 mm. The difference (D1max−D1min) is yet more preferably 0 mm.

From the viewpoint of efficiently increasing the additional area S2, the length of the contour proximate side CS is preferably greater than or equal to 20 mm, more preferably greater than or equal to 30 mm, and still more preferably greater than or equal to 40 mm. From the viewpoint of reducing air resistance at the position 6 by suppressing an excessive extension of the protruding portion toward the face side, the length of the contour proximate side CS is preferably less than or equal to 90 mm, more preferably less than or equal to 80 mm, and still more preferably less than or equal to 70 mm. This length of the contour proximate side CS is the actual length (route length which is three-dimensionally measured) of the contour proximate side CS.

It is preferable that the contour proximate side CS is provided with a sidewall surface. That is, the protruding portion preferably includes a sidewall surface having the contour proximate side CS as its lower edge. In the embodiment of FIG. 3, the contour proximate side CS is provided with the sidewall surface 24. Such a part of the sidewall surface 24 which has the contour proximate side CS as its lower edge is also referred to as a contour proximate wall surface. The contour proximate wall surface CW can efficiently increase the additional area S2 in the heel projection figure.

By increasing the height of the contour proximate wall surface CW, the additional area S2 can be efficiently increased. From this viewpoint, the height H1 of the upper edge of the contour proximate wall surface CW is preferably greater than or equal to 1 mm, more preferably greater than or equal to 2 mm, and still more preferably greater than or equal to 3 mm. From the viewpoint of the degree of freedom in designing the position of the head center of gravity, the height H1 of the upper edge of the contour proximate wall surface CW is preferably less than or equal to 20 mm, more preferably less than or equal to 18 mm, and still more preferably less than or equal to 15 mm.

From the viewpoint of reducing air resistance at the position 6 while increasing the additional area S2 in the heel projection figure, the upper edge of the contour proximate wall surface CW may include a point where the height H1 of the protruding portion 20 is at the maximum.

In the plan view of FIG. 3, the first side CL21 of the contour line CL20 of the protruding portion 20 is a side (hereinafter, referred to as opposing side PS) that is opposed to the contour proximate side CS. The length of the opposing side PS is preferably shorter than the length of the contour proximate side CS. By shortening the opposing side PS, the influence of the protruding portion on airflow at the position 6 can be reduced while the additional area S2 is enlarged. The length of the opposing side PS is the actual length (route length which is three-dimensionally measured) of the opposing side PS. A ratio of the length of the opposing side PS to the length of the contour proximate side CS is preferably less than or equal to 90%, more preferably less than or equal to 80%, and still more preferably less than or equal to 70%. The ratio of the length of the opposing side PS to the length of the contour proximate side CS may be 0%.

By lowering the height of the opposing side PS, air resistance at the position 6 can be reduced. From this viewpoint, the opposing side PS is not provided with a sidewall surface, preferably.

In the plan view of the head 4 (FIG. 3), the protruding portion 20 includes a taper-shaped portion in which a width W1 decreases from the contour proximate wall surface CW toward the opposing side PS. This taper-shaped portion contributes to reducing the influence of the protruding portion on air flow at the position 6 while enlarging the additional area S2. The width W1 can be measured along a direction of a straight line that connects both ends of the opposing side PS.

Examples

Although advantageous effects of the present disclosure are demonstrated by the following examples, the present disclosure should not be construed restrictively on the basis of the descriptions of the examples.

[Test 1: Evaluation Performed by Actually Hitting Balls]

Testers actually hit balls with a club A having no protruding portion and a club B having a protruding portion to evaluate the effect of the protruding portion.

The testers were nine golfers who swing a driver at a head speed of 34 m/s to 39 m/s. As the club A having no protruding portion, a driver of XXIO Eleven (shaft flex: R, loft angle: 10.5°) was used. As the club B having a protruding portion, a club obtained by bonding a protruding portion that is formed by a sponge mockup to the crown portion of the head of the club A was used. The sponge mockup was made of a sponge material (EVA foam) and had a light weight. The club A and the club B were adjusted to have a same head weight. The position and the shape of the protruding portion were the same as those of the head 4 of the first embodiment described above.

Each of the above-mentioned nine testers hit eight golf balls with each club. For the respective hittings, head speeds, positions of hitting points, face angles at impact, and initial velocities of hit balls were measured. As to each club of each tester, the average value of the head speeds, the variation (standard deviation σ) of the head speeds, the average value of distances between the hitting points and the face center, the variation (standard deviation σ) of the distances between the hitting points and the face center, the average value of the face angles, the variation (standard deviation σ) of the face angles, and the average value of smash factors were calculated from measured data.

Figure 27A:
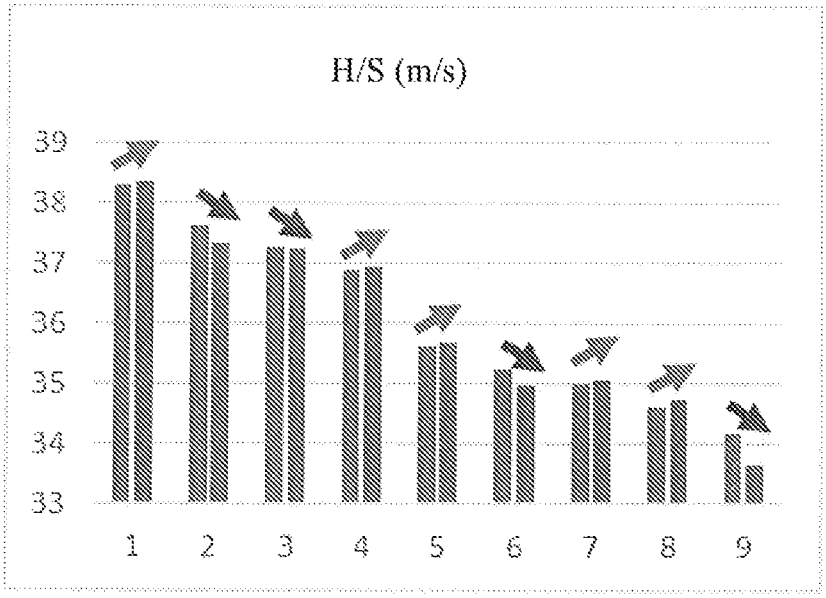
FIG. 27A shows average values of head speeds (H/S) of respective testers 1 to 9, a left column of each tester showing the result of a club A (having no protruding portion), and a right column of each tester showing the result of a club B (having a protruding portion)

FIG. 27A shows the average values of head speeds (H/S) for the respective testers 1 to 9. A left column for each tester shows the result of the club A (with no protruding portion), and a right column for each tester shows the result of the club B (with protruding portion). Each arrow indicates whether the head speed was increased or decreased by providing the protruding portion. The head speed remained almost unchanged whether the protruding portion was present or not. It was confirmed that head speed was not reduced by providing the protruding portion.

Figure 27B:
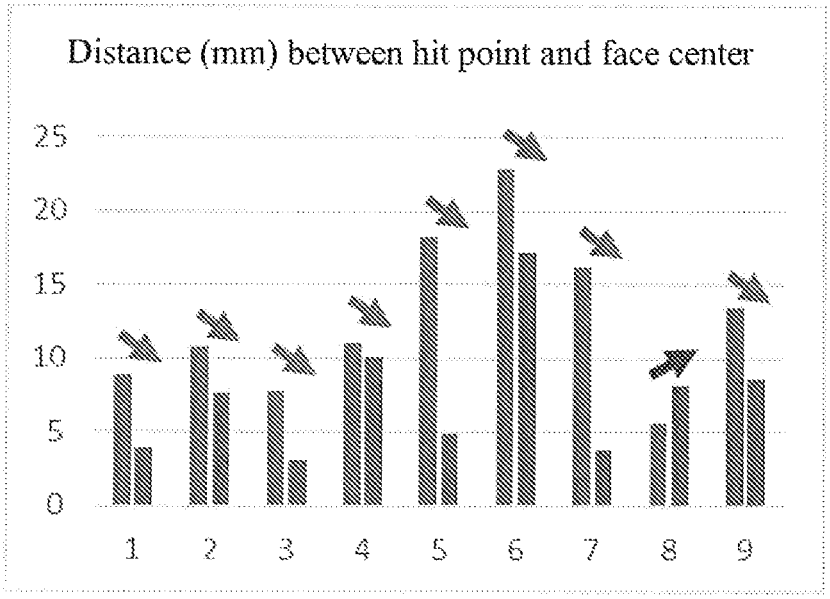
FIG. 27B shows average values of distances between hit points and a face center for the respective testers 1 to 9, a left column of each tester showing the result of the club A (having no protruding portion), and a right column of each tester showing the result of the club B (having a protruding portion)

FIG. 27B shows the average values of distances between the hit points and the face center for the respective testers 1 to 9. A left column for each tester shows the result of the club A, and a right column for each tester shows the result of the club B. Each arrow indicates whether the distance was increased or decreased by providing the protruding portion. The distance was decreased in the results of eight testers out of the nine testers. It was confirmed that the presence of the protruding portion optimized (suppressed) the toe down, and made the hit point closer to the face center.

Figure 28A:
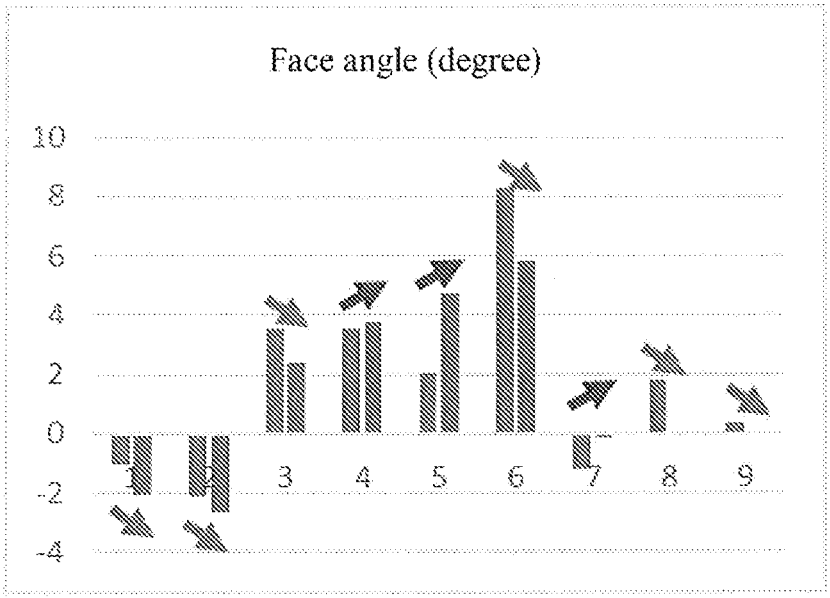
FIG. 28A shows average values of face angles of the respective testers 1 to 9, a left column of each tester showing the result of the club A, and a right column of each tester showing the result of the club B.

FIG. 28A shows the average values of the face angles for the respective testers 1 to 9. A left column for each tester shows the result of the club A, and a right column for each tester shows the result of the club B. Each arrow indicates whether the face angle was increased or decreased by providing the protruding portion. The face angle is most preferably 0°. Of the nine testers, five testers had a result in which the face angle became closer to 0° by the presence of the protruding portion. Of these five testers, three testers had a face angle of almost 0° in the club B. It was confirmed that the presence of the protruding portion optimized (suppressed) the toe down, and made the face angle closer to 0°, that is, a square face angle.

Figure 28B:
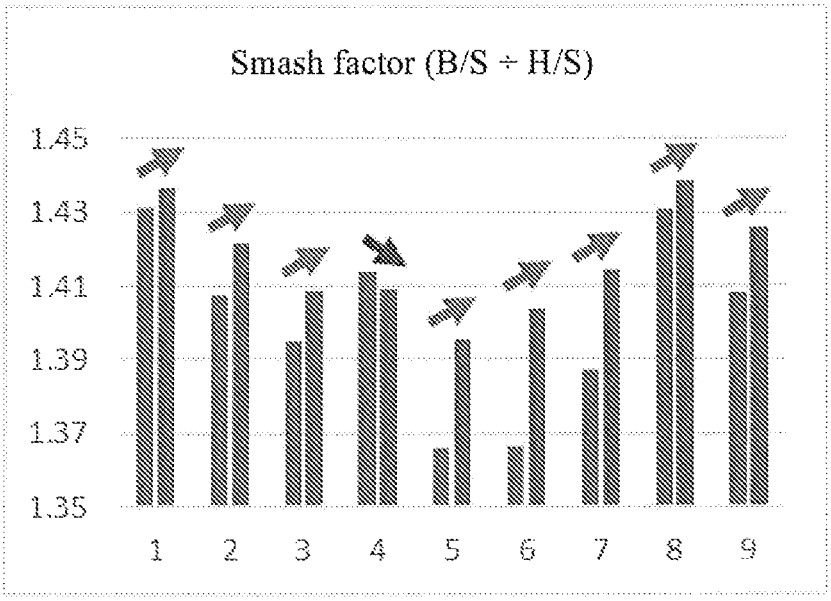
FIG. 28B shows average values of smash factors of the respective testers 1 to 9, the smash factor being calculated by dividing an initial velocity of a hit ball (B/S) by a head speed (H/S), a left column of each tester showing the result of the club A, and a right column of each tester showing the result of the club B.

FIG. 28B shows the average values of smash factors for the respective testers 1 to 9. The smash factor was calculated by dividing the initial velocity of a hit ball (B/S) by the head speed (H/S). A left column for each tester shows the result of the club A, and a right column for each tester shows the result of the club B. Each arrow indicates whether the smash factor was increased or decreased by providing the protruding portion. The smash factor was increased in the results of eight testers out of the nine testers. It was confirmed that the presence of the protruding portion optimized (suppressed) the toe down, and improved the hit point and/or impact angle, whereby the smash factor was increased.

Figure 29A:
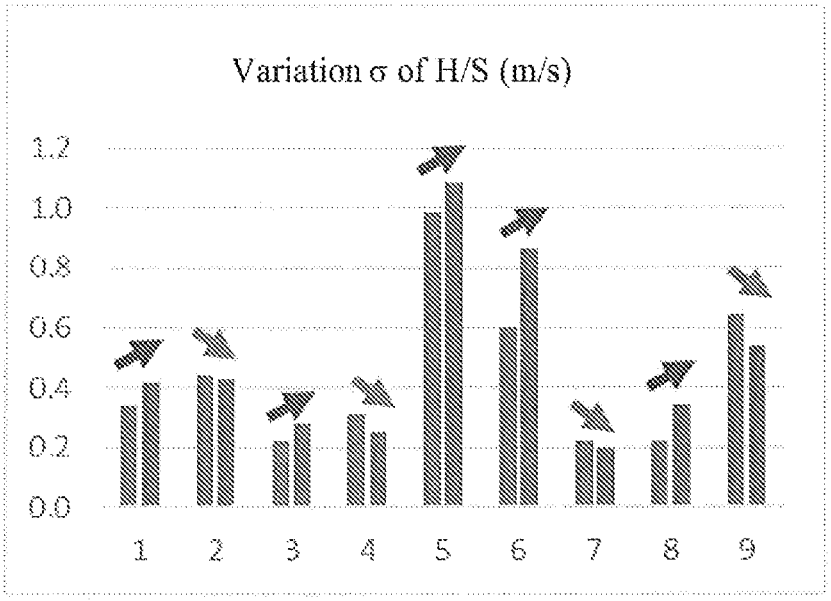
FIG. 29A shows standard deviations of head speeds (H/S) of the respective testers 1 to 9, a left column of each tester showing the result of the club A, and a right column of each tester showing the result of the club B.

FIG. 29A shows the standard deviations of the head speeds (H/S) for the respective testers 1 to 9. A left column for each tester shows the result of the club A, and a right column for each tester shows the result of the club B. Each arrow indicates whether the variation of head speeds was increased or decreased by providing the protruding portion. The variation of head speeds remained almost unchanged whether the protruding portion was present or not.

Figure 29B:
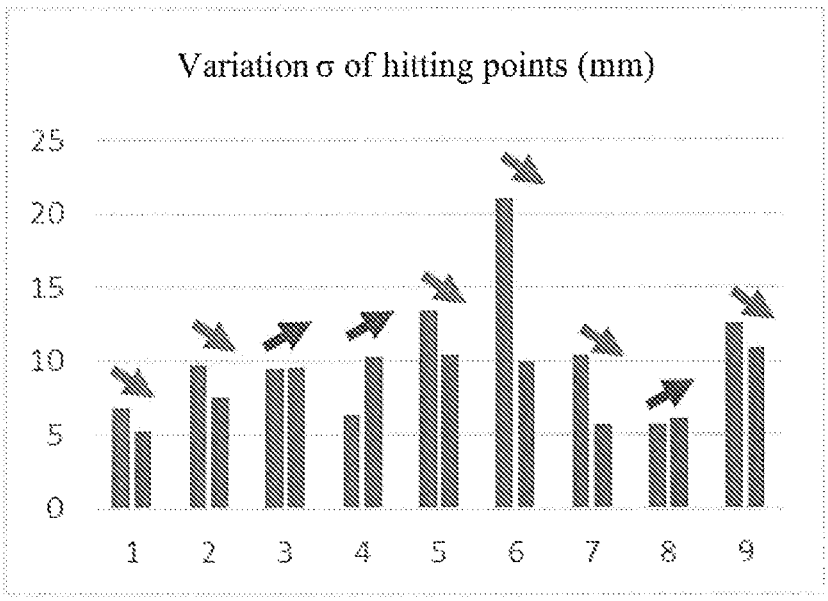
FIG. 29B shows standard deviations of the distances between the hit points and the face center for the respective testers 1 to 9, a left column of each tester showing the result of the club A, and a right column of each tester showing the result of the club B.

FIG. 29B shows the standard deviations of the distances between the hit points and the face center for the respective testers 1 to 9. A left column for each tester shows the result of the club A, and a right column for each tester shows the result of the club B. Each arrow indicates whether the variation was increased or decreased by providing the protruding portion. The variation was decreased in the results of six testers out of the nine testers. It was confirmed that the presence of the protruding portion stabilized the toe down, and decreased the variation of hit points.

Figure 30:
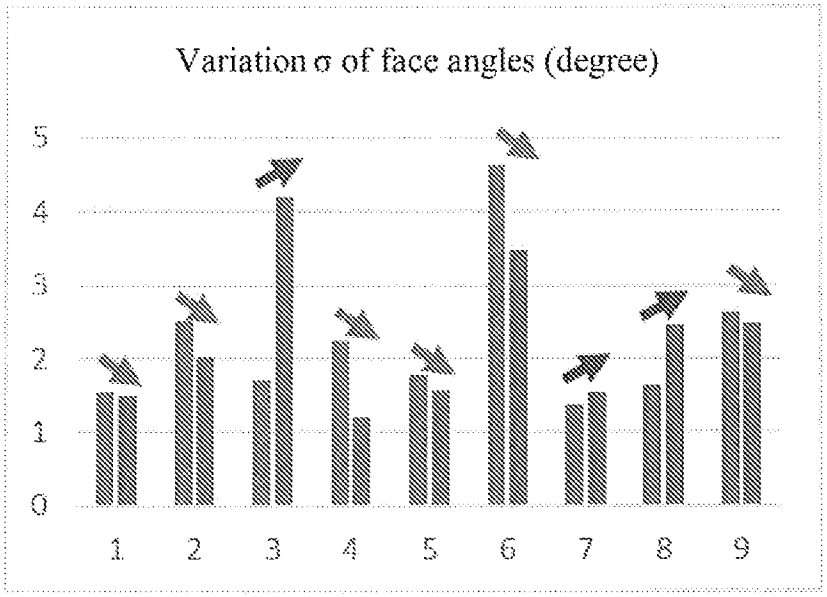
FIG. 30 shows standard deviations of the face angles of the respective testers 1 to 9, a left column of each tester showing the result of the club A, and a right column of each tester showing the result of the club B.

FIG. 30 shows the standard deviations of the face angles for the respective testers 1 to 9. A left column for each tester shows the result of the club A, and a right column for each tester shows the result of the club B. Each arrow indicates whether the variation was increased or decreased by providing the protruding portion. The variation was decreased in the results of six testers out of the nine testers. It was confirmed that the presence of the protruding portion stabilized the toe down, and decreased the variation of face angles.

[Test 2: Evaluation Using a Swing Machine]

Each of the above-described club A and club B was swung by a swing machine to observe toe down. This observation was performed by using Computer Controlled Hitting Machine manufactured by Golf Laboratories, Inc. as the swing machine and setting a head speed at impact at 40 m/s. The amount of bending of the shaft at impact for each club was also observed by attaching a strain gauge to the shaft. As a result, the amount of bending at impact toward the toe-down side of the club B (with the protruding portion) was reduced by 4% (about 3 mm) as compared with that of the club A (with no protruding portion). In addition, the amount of change in hitting points was measured using a pressure-sensitive paper. The hitting point of the club B was shifted toward the heel side and the sole side as compared with that of the club A. The distance between the hitting points of the club A and club B was about 6 mm. Thus, it was confirmed in the observation using the swing machine that the protruding portion suppressed the toe down.

[Test 3: Aerodynamics Simulation]

Simulations were performed to observe changes of aerodynamic drag and lifting force acting on heads. The simulations were performed by using "STAR-CCM" manufactured by Siemens Digital Industries Software as a software, and utilizing polyhedral rear fine meshes. The shape and the position of the protruding portion were the same as those of the head 4 of the first embodiment. The maximum value of the height H1 of the protruding portion was 3 mm. The head speed during downswing was set to 20 m/s at the position 9, 30 m/s at the position 7.5, and 40 m/s at the position 6. As a result, the aerodynamic drag at the position 9 was increased by 13% in the head advancing direction (i.e., the inclined toe-heel direction) at the position 9. On the other hand, the aerodynamic drag at the position 6 (impact) was reduced by 2% in the head advancing direction (i.e., the face-back direction) at the position 6. The lifting force at the position 9 was increased by 28% in the direction perpendicular to the head advancing direction (i.e., the inclined toe-heel direction) at the position 9. The increased aerodynamic drag and the increased lifting force cancelled centrifugal force and reduced the magnitude of a force acting in the direction perpendicular to the shaft axis line. The increased aerodynamic drag and the increased lifting force reduced the magnitude of the force acting in the direction perpendicular to the shaft axis line by about 1% at the position 9. As described above, it was confirmed that the protruding portion increased aerodynamic drag and lifting force at the position 9, whereby the toe down was suppressed.

As shown by these evaluation results, the superiority of the present disclosure is clear.

Regarding the above-described embodiment, the following clauses are disclosed.

[Clause 1]

A golf club head including:

a face portion that forms a striking face;

a crown portion that forms a crown outer surface;

a sole portion that forms a sole outer surface; and a hosel portion that is configured to receive a shaft and that defines a shaft axis line, wherein the crown portion includes a protruding portion on the crown outer surface, in a front view of the golf club head as viewed from a face side, the protruding portion does not form any part of an outer contour line of the golf club head, and in a heel projection figure in which the golf club head that is placed on a ground plane such that the shaft axis line is perpendicular to the ground plane and a face angle is set at 0° is viewed from a heel side along the ground plane, the protruding portion forms a part of an outer contour line of the golf club head.

[Clause 2]

The golf club head according to clause 1, wherein the protruding portion includes an upper surface and a sidewall surface that extends from the upper surface to an outer edge of the protruding portion.

[Clause 3]

The golf club head according to clause 2, wherein a height of the upper surface decreases toward a head center side.

[Clause 4]

The golf club head according to clause 2, wherein a height of the upper surface of the protruding portion decreases toward the face side.

[Clause 5]

The golf club head according to clause 2, wherein a height of the upper surface of the protruding portion decreases toward a back side.

[Clause 6]

The golf club head according to any one of clauses 1 to 5, wherein a space is formed between a highest portion of the protruding portion and the crown outer surface.

[Clause 7]

The golf club head according to clause 1, wherein the protruding portion includes a ridgeline formed by vertices, and a sidewall surface that extends from the ridgeline to an outer edge of the protruding portion.

[Clause 8]

The golf club head according to any one of clauses 1 to 7, wherein the golf club head includes a head body that forms the crown portion, and a protruding member that forms the protruding portion and is detachably fixed to the head body.

[Clause 9]

The golf club head according to clause 8, wherein the protruding member is detachably fixed to the head body with a fixing jig.

[Clause 10]

The golf club head according to any one of clauses 1 to 9, wherein in a planar view of the golf club head, when an area of the protruding portion is denoted by St, and, of the crown outer surface, an area of a portion located on the heel side with respect to a face center is denoted by Sh, then a ratio of the area St to the area Sh is greater than or equal to 5% and less than or equal to 70%.

[Clause 11]

A golf club including any one of the golf club heads according to clauses 1 to 10, a grip, and a shaft, wherein the golf club head is attached to a tip end portion of the shaft, and the grip is attached to a butt end portion of the shaft.

LIST OF REFERENCE NUMERALS

2 Golf club
4, 60, 80, 100, 120, 140, 160, 180 Head
6 Shaft
10 Face portion
10*a* Striking face
12 Crown portion
12*a* Crown outer surface
12*b* Crown base surface
12*c* Virtually extended surface
12*d* Virtually extended line
12*e* Virtually extended line
14 Sole portion
16 Hosel portion
20, 70, 90, 110, 130, 150, 170, 190 Protruding portion
22 Upper surface
24 Sidewall surface
174, 198 Protruding member
CL1 Outer contour line of a head in the front view as viewed from the face side
CL6 Outer contour line of the heel projection figure
Z Shaft axis line
CG Head center of gravity The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head comprising:

a face portion that forms a striking face;

a crown portion that forms a crown outer surface;

a sole portion that forms a sole outer surface; and a hosel portion that is configured to receive a shaft and that defines a shaft axis line, wherein the crown portion includes a protruding portion on the crown outer surface, in a front view of the golf club head as viewed from a face side, the protruding portion does not form any part of an outer contour line of the golf club head, wherein in a heel projection figure in which the golf club head that is placed on a ground plane such that the shaft axis line is perpendicular to the ground plane and a face angle is set at 0° is viewed from a heel side along the ground plane, the protruding portion forms a part of an outer contour line of the golf club head, wherein the protruding portion includes an upper surface and a sidewall surface that extends from the upper surface to an outer edge of the protruding portion, wherein the protruding portion has a contour line that includes a contour proximate side that is a side closest to the outer contour line in a planar view of the golf club head, wherein the sidewall surface includes a contour proximate wall surface that has the contour proximate side as a lower edge of the contour proximate wall surface, and wherein in the planar view of the golf club head, when an area of the protruding portion is denoted by St, and, of the crown outer surface, an area of a portion located on the heel side with respect to a face center is denoted by Sh, then a ratio of the area St to the area Sh is greater than or equal to 5% and less than or equal to 70%.

2. The golf club head according to claim 1, wherein a height of the upper surface decreases toward a head center side.

3. The golf club head according to claim 1, wherein a height of the upper surface of the protruding portion decreases toward the face side.

4. The golf club head according to claim 1, wherein a space is formed between a highest portion of the protruding portion and the crown outer surface.

5. The golf club head according to claim 1, wherein the golf club head includes a head body that forms the crown portion, and a protruding member that forms the protruding portion and is detachably fixed to the head body.

6. The golf club head according to claim 5, wherein the protruding member is detachably fixed to the head body with a fixing jig.

7. A golf club comprising the golf club head according to claim 1, a grip, and a shaft, wherein the golf club head is attached to a tip end portion of the shaft, and the grip is attached to a butt end portion of the shaft.

8. The golf club head according to claim 1, wherein an uppermost point in the protruding portion is located on a lower side in an up-down direction of the golf club head with respect to an uppermost point in the hosel portion.

9. The golf club head according to claim 1, wherein an uppermost point in the protruding portion is located on a lower side in an up-down direction of the golf club head with respect to a top of the crown outer surface.

10. The golf club head according to claim 1, wherein the ratio of the area St to the area Sh is greater than or equal to 15%.

11. A golf club head comprising:

a face portion that forms a striking face;

a crown portion that forms a crown outer surface;

a sole portion that forms a sole outer surface; and a hosel portion that is configured to receive a shaft and that defines a shaft axis line, wherein the crown portion includes a protruding portion on the crown outer surface, wherein in a front view of the golf club head as viewed from a face side, the protruding portion does not form any part of an outer contour line of the golf club head, wherein in a heel projection figure in which the golf club head that is placed on a ground plane such that the shaft axis line is perpendicular to the ground plane and a face angle is set at 0° is viewed from a heel side along the ground plane, the protruding portion forms a part of an outer contour line of the golf club head, wherein the protruding portion includes an upper surface and a sidewall surface that extends from the upper surface to an outer edge of the protruding portion, wherein the protruding portion has a contour line that includes a contour proximate side that is a side closest to the outer contour line in a planar view of the golf club head, wherein the sidewall surface includes a contour proximate wall surface that has the contour proximate side as a lower edge of the contour proximate wall surface, and wherein a height of the upper surface of the protruding portion decreases toward a back side of the golf club head.

12. A golf club head comprising:

a face portion that forms a striking face;

a crown portion that forms a crown outer surface;

a sole portion that forms a sole outer surface; and a hosel portion that is configured to receive a shaft and that defines a shaft axis line, wherein the crown portion includes a protruding portion on the crown outer surface, wherein in a front view of the golf club head as viewed from a face side, the protruding portion does not form any part of an outer contour line of the golf club head, wherein in a heel projection figure in which the golf club head that is placed on a ground plane such that the shaft axis line is perpendicular to the ground plane and a face angle is set at 0° is viewed from a heel side along the ground plane, the protruding portion forms a part of an outer contour line of the golf club head, wherein the protruding portion has a contour line that includes a contour proximate side that is a side closest to the outer contour line in a planar view of the golf club head, wherein the protruding portion includes a ridgeline formed by vertices, and a sidewall surface that extends from the ridgeline to an outer edge of the protruding portion wherein the sidewall surface includes a contour proximate wall surface that has the contour proximate side as a lower edge of the contour proximate wall surface.

13. A golf club head comprising:

a face portion that forms a striking face;

a crown portion that forms a crown outer surface;

a sole portion that forms a sole outer surface; and a hosel portion that is configured to receive a shaft and that defines a shaft axis line, wherein the crown portion includes a protruding portion on the crown outer surface, wherein in a front view of the golf club head as viewed from a face side, the protruding portion does not form any part of an outer contour line of the golf club head, wherein in a heel projection figure in which the golf club head that is placed on a ground plane such that the shaft axis line is perpendicular to the ground plane and a face angle is set at 0° is viewed from a heel side along the ground plane, the protruding portion forms a part of an outer contour line of the golf club head, wherein the protruding portion includes an upper surface and a sidewall surface that extends from the upper surface to an outer edge of the protruding portion, wherein the protruding portion has a contour line that includes a contour proximate side that is a side closest to the outer contour line in a planar view of the golf club head, wherein the sidewall surface includes a contour proximate wall surface that has the contour proximate side as a lower edge of the contour proximate wall surface, wherein a silhouette area of the golf club head in the heel projection figure is enlarged by the protruding portion, and wherein, of the silhouette area, an additional area that is added by the protruding portion is greater than or equal to 30 $mm^2$ and less than or equal to 500 $mm^2$.

14. A golf club head comprising:

a face portion that forms a striking face;

a crown portion that forms a crown outer surface;

a sole portion that forms a sole outer surface; and a hosel portion that is configured to receive a shaft and that defines a shaft axis line, wherein the crown portion includes a protruding portion on the crown outer surface, wherein in a front view of the golf club head as viewed from a face side, the protruding portion does not form any part of an outer contour line of the golf club head, wherein in a heel projection figure in which the golf club head that is placed on a ground plane such that the shaft axis line is perpendicular to the ground plane and a face angle is set at 0° is viewed from a heel side along the ground plane, the protruding portion forms a part of an outer contour line of the golf club head, wherein the protruding portion includes an upper surface and a sidewall surface that extends from the upper surface to an outer edge of the protruding portion, wherein the protruding portion has a contour line that includes a contour proximate side that is a side closest to the outer contour line in a planar view of the golf club head, wherein the sidewall surface includes a contour proximate wall surface that has the contour proximate side as a lower edge of the contour proximate wall surface, wherein a silhouette area of the golf club head in the heel projection figure is enlarged by the protruding portion, and wherein, when the silhouette area is denoted by S1, and, of the silhouette area S1, an additional area that is added by the protruding portion is denoted by S2, then S2/S1 is greater than or equal to 0.005 and less than or equal to 0.10.

15. A golf club head comprising:

a face portion that forms a striking face;

a crown portion that forms a crown outer surface;

a sole portion that forms a sole outer surface; and a hosel portion that is configured to receive a shaft and that defines a shaft axis line, wherein the crown portion includes a protruding portion on the crown outer surface, wherein in a front view of the golf club head as viewed from a face side, the protruding portion does not form any part of an outer contour line of the golf club head, wherein in a heel projection figure in which the golf club head that is placed on a ground plane such that the shaft axis line is perpendicular to the ground plane and a face angle is set at 0° is viewed from a heel side along the ground plane, the protruding portion forms a part of an outer contour line of the golf club head, wherein the protruding portion includes an upper surface and a sidewall surface that extends from the upper surface to an outer edge of the protruding portion, wherein the protruding portion has a contour line that includes a contour proximate side that is a side closest to the outer contour line in a planar view of the golf club head, wherein the sidewall surface includes a contour proximate wall surface that has the contour proximate side as a lower edge of the contour proximate wall surface, wherein the striking face includes a face center, and wherein an entirety of the protruding portion is located on the heel side with respect to the face center.

16. A golf club head comprising:

a face portion that forms a striking face;

a crown portion that forms a crown outer surface;

a sole portion that forms a sole outer surface; and a hosel portion that is configured to receive a shaft and that defines a shaft axis line, wherein the crown portion includes a protruding portion on the crown outer surface, in a front view of the golf club head as viewed from a face side, the protruding portion does not form any part of an outer contour line of the golf club head, in a heel projection figure in which the golf club head that is placed on a ground plane such that the shaft axis line is perpendicular to the ground plane and a face angle is set at 0° is viewed from a heel side along the ground plane, the protruding portion forms a part of an outer contour line of the golf club head, a silhouette area of the golf club head in the heel projection figure is enlarged by the protruding portion, of the silhouette area, an additional area that is added by the protruding portion is greater than or equal to 30 $mm^2$ and less than or equal to 500 $mm^2$, and when the silhouette area is denoted by S1, and the additional area added by the protruding portion is denoted by S2, then S2/S1 is greater than or equal to 0.005 and less than or equal to 0.10.

* * * * *